US010609504B2

(12) United States Patent
Park et al.

(10) Patent No.: US 10,609,504 B2
(45) Date of Patent: Mar. 31, 2020

(54) AUDIO SIGNAL PROCESSING METHOD AND APPARATUS FOR BINAURAL RENDERING USING PHASE RESPONSE CHARACTERISTICS

(71) Applicant: GAUDI AUDIO LAB, INC., Seoul (KR)

(72) Inventors: Kyutae Park, Seoul (KR); Jeonghun Seo, Seoul (KR); Sangbae Chon, Seoul (KR); Sewoon Jeon, Daejeon (KR); Hyunoh Oh, Seongnam-si (KR)

(73) Assignee: GAUDI AUDIO LAB, INC., Seoul (KR)

( * ) Notice: Subject to any disclaimer, the term of this patent is extended or adjusted under 35 U.S.C. 154(b) by 0 days.

(21) Appl. No.: 16/212,620

(22) Filed: Dec. 6, 2018

(65) Prior Publication Data

US 2019/0200159 A1 Jun. 27, 2019

(30) Foreign Application Priority Data

Dec. 21, 2017 (KR) ..... 10-2017-0176720
May 2, 2018 (KR) ..... 10-2018-0050407

(51) Int. Cl.
*H04S 7/00* (2006.01)
*G10L 21/02* (2013.01)
(Continued)

(52) U.S. Cl.
CPC ..... *H04S 7/304* (2013.01); *G10L 21/02* (2013.01); *H04R 3/04* (2013.01); *H04R 5/033* (2013.01);
(Continued)

(58) Field of Classification Search
CPC ..... H04S 2420/01; H04S 7/304; G10L 21/02; H04R 5/04; H04R 3/04; H04R 5/033
See application file for complete search history.

(56) References Cited

U.S. PATENT DOCUMENTS 8,428,269 B1 4/2013 Brungart et al.
2006/0277034 A1* 12/2006 Sferrazza ..... H04S 7/30 704/200.1
(Continued)

FOREIGN PATENT DOCUMENTS

JP H10-136497 A 5/1998
JP 2005-005949 A 1/2005
JP 2015-515185 A 5/2015

OTHER PUBLICATIONS

Japanese Office Action in Appln. No. 2018-236227 dated Feb. 3, 2020 with English translation, 7pages.

*Primary Examiner* — Regina N Holder
(74) *Attorney, Agent, or Firm* — Park, Kim & Suh, LLC

(57) ABSTRACT

Disclosed is an audio signal processing device including a processor for outputting an output audio signal generated based on an input audio signal. The processor may be configured to obtain a first pair of head-related transfer function (HRTF)s including a first ipsilateral HRTF and a first contralateral HRTF based on a position of a virtual sound source corresponding to the input audio signal, from a first set of transfer functions including HRTFs corresponding to each specific position with respect to listener, and generate the output audio signal by performing binaural rendering the input audio signal based on the first pair of HRTFs.

18 Claims, 27 Drawing Sheets

(51) Int. Cl.
*H04R 3/04* (2006.01)
*H04R 5/033* (2006.01)
*H04R 5/04* (2006.01)

(52) U.S. Cl.
CPC ..... *H04R 5/04* (2013.01); *H04R 2420/01* (2013.01); *H04S 2400/11* (2013.01); *H04S 2420/01* (2013.01)

(56) References Cited

U.S. PATENT DOCUMENTS

2016/0044430 A1* 2/2016 McGrath ..... H04S 1/005
381/17
2017/0272882 A1* 9/2017 Oh ..... H04S 1/00
2017/0325045 A1* 11/2017 Baek ..... H04S 1/002

* cited by examiner

AUDIO SIGNAL PROCESSING METHOD AND APPARATUS FOR BINAURAL RENDERING USING PHASE RESPONSE CHARACTERISTICS

CROSS-REFERENCE TO RELATED PATENT APPLICATION

This application claims the benefit of Korean Patent Application No. 10-2017-0176720, filed on Dec. 21, 2017, and Korean Patent Application No. 10-2018-0050407, filed on May 2, 2018, in the Korean Intellectual Property Office, the disclosure of which is incorporated herein in its entirety by reference.

TECHNICAL FIELD

The present disclosure relates to a signal processing method and device for effectively reproducing an audio signal, and more particularly, to a signal processing method and device to provide an interactive and an immersive three-dimensional audio signal in a head mounted display (HMD).

BACKGROUND ART

A binaural rendering technology is essentially required to provide immersive and interactive audio in a head mounted display (HMD) device. Binaural rendering represents modeling a 3D audio, which provides a sound that gives a sense of presence in a three-dimensional space, into a signal to be delivered to the ears of a human being. A listener may be experienced a sense of three-dimensionality from a binaural rendered 2-channel audio output signal through a headphone, an earphone, or the like. A specific principle of the binaural rendering is described as follows. A human being listens to a sound through both ears, and recognizes the position and the direction of a sound source from the sound. Therefore, if a 3D audio may be modeled into audio signals to be delivered to both ears of a human being, the three-dimensionality of 3D audio may be reproduced through a 2-channel audio output without a large number of speakers.

Here, when the number of channels or objects included in an audio signal to be binaural rendered increases, the amount of calculation and power consumption required for binaural rendering may be increased. Therefore, a technology for efficiently performing binaural rendering on an input audio signal is required in a mobile device limited in calculation amount and power consumption.

Furthermore, the number of head related transfer functions (HRTFs) obtainable by the audio signal processing device may be limited due to limited memory capacity and constraints in the measurement process. This may cause degradation of the sound localization performance of the audio signal processing device. Therefore, additional processing of the audio signal processing device for the input HRTF may be required to increase the communicative resolution of the audio signal being reproduced on the three-dimensional space. In addition, a binaural rendered audio signal in a virtual reality may be combined with additional signals to improve reproducibility. In this case, when the audio signal processing device synthesizes the binaural rendered audio signal and the additional signal in time domain, the sound quality of the output audio signal may be degraded due to a comb-filtering effect. This is because timbre may be distorted due to binaural rendering and the different delays of additional signals. Further, when the audio signal processing device synthesizes the binaural-rendered audio signal and the additional signal in frequency domain, an additional amount of computation is required as compared with the case of using only binaural rendering. There is thus a need for techniques to preserve the timbre of an input audio signal while reducing the amount of computation in further processing and synthesis.

DISCLOSURE OF THE INVENTION

Technical Problem

An object of an embodiment of the present disclosure is to reduce a distortion of timbre due to a comb-filtering effect in generating an output audio signal by binaural rendering an input audio signal based on a plurality of filters.

Technical Solution

An audio signal processing device according to an embodiment of the present disclosure includes a processor for outputting an output audio signal generated based on an input audio signal. The processor may be obtain a first pair of head-related transfer function (HRTF)s including a first ipsilateral HRTF and a first contralateral HRTF based on a position of a virtual sound source corresponding to an input audio signal, from a first set of transfer functions including HRTFs corresponding to each specific position with respect to a listener, and generate an output audio signal by performing binaural rendering the input audio signal based on the first pair of HRTFs, and wherein a phase response of each of the plurality of ipsilateral HRTFs included in the first set of transfer functions in a frequency domain may be the same regardless of the position of the each of the plurality of ipsilateral HRTFs. A phase response of the first ipsilateral HRTF may be a linear phase response.

A contralateral group-delay corresponding to a phase response of the first contralateral HRTF may be determined based on an ipsilateral group-delay corresponding to the modified phase response of the first ipsilateral HRTF, and the phase response of the first contralateral HRTF may be a linear phase response.

The contralateral group-delay may be a value determined by using an interaural time difference (ITD) information with respect to the ipsilateral group-delay.

The ITD information may be a value obtained based on a measured pair of HRTFs, and the measured pair of HRTFs corresponds to the position of the virtual sound source with respect to the listener.

The contralateral group-delay may be a value determined by using a head modeling information of the listener with respect to the ipsilateral group-delay.

The ipsilateral group-delay and the contralateral group-delay are integer multiples of a sample according to a sampling frequency in the time domain.

The processor may be configured to generate the output audio signal, in the time domain, by delaying the input audio signal based on the contralateral group-delay and the ipsilateral group-delay, respectively.

The processor may be configured to generate a final output audio signal based on the phase response modified first pair of HRTFs and an additional audio signal in the time domain, and output the final output audio signal. An ipsilateral group-delay of the additional audio signal may be the same as the ipsilateral group-delay of the first ipsilateral HRTF group-delay and a contralateral group-delay of the additional audio signal may be the same as the contralateral group-delay of the first contralateral HRTF.

The processor may be configured to obtain a panning gain according to the position of the virtual sound source with respect to the listener, filter the input audio signal based on the panning gain, and delay the filtered input audio signal based on the ipsilateral group-delay of the first ipsilateral group-delay and the contralateral group-delay of the first contralateral group-delay to generate the additional audio signal.

The processor may be configured to generate the output signal by binaural rendering the input audio signal based on the first pair of HRTFs, generate the additional audio signal by filtering the input audio signal based on an additional filter pair including an ipsilateral additional filter and a contralateral additional filter, and generate the final output audio signal by mixing the output audio signal and the additional audio signal in the time domain. A phase response of the ipsilateral additional filter may be the same as the phase response of the first ipsilateral HRTF, and a phase response of the contralateral additional filter may be the same as the phase response of the first contralateral HRTF.

The additional filter pair may be a filter generated based on a panning gain according to the position of the virtual sound source with respect to the listener, and a magnitude component of frequency response of each of the ipsilateral additional filter and the contralateral additional filter may be constant.

The additional filter pair may be a filter generated based on a size of an object modeled by the virtual sound source and a distance from the listener to the virtual sound source.

A phase response of each of a plurality of HRTFs included in the first set of transfer functions in the frequency domain may be the same each other regardless of the position corresponding to each of the plurality of HRTFs. The processor may be configured to obtain the first pair of HRTFs based on at least two pairs of HRTFs when the position of the virtual sound source may be a position other than a position corresponding to each of the plurality of HRTFs. The at least two pairs of HRTFs may be obtained based on the position of the virtual sound source from the first set of transfer functions.

The processor may be configured to obtain the first pair of HRTFs by interpolating the at least two pairs of HRTFs in a time domain.

The processor may be configured to obtain a second pair of HRTFs including a second ipsilateral HRTF and a second contralateral HRTF, based on the position of the virtual sound source, from a second set of transfer functions other than the first set of transfer functions, and generate the output audio signal based on the first pair of HRTFs and the second pair of HRTFs. A phase response of the second ipsilateral HRTF may be same as the phase response of the first ipsilateral HRTF, and a phase response of the second contralateral HRTF may be the same as the phase response of the first contralateral HRTF.

An operation method for an audio signal processing device outputting an output audio signal generated based on an input audio signal including the steps of: obtaining a pair of head-related transfer function (HRTF)s including a ipsilateral HRTF and a contralateral HRTF based on a position of a virtual sound source corresponding to an input audio signal, from a set of transfer functions including HRTFs corresponding to each specific position with respect to a listener; and generating an output audio signal by performing binaural rendering the input audio signal based on the pair of HRTFs. A phase response of each of the plurality of ipsilateral HRTFs included in the set of transfer functions in a frequency domain may be the same regardless of the position of the each of the plurality of ipsilateral HRTFs.

An audio signal processing device according to an embodiment of the present disclosure includes a processor for outputting an output audio signal generated based on an input audio signal. The processor may be configured to obtain a first pair of head-related transfer function (HRTF)s including a first ipsilateral HRTF and a first contralateral HRTF based on a position of a virtual sound source corresponding to the input audio signal, from a first set of transfer functions including HRTFs corresponding to each specific position with respect to listener, modify a phase response of the first ipsilateral HRTF in a frequency domain to be a specific phase response that may be the same regardless of the position of the virtual sound source, and generate the output audio signal by performing binaural rendering the input audio signal based on the first pair of HRTFs of which the phase response of the first ipsilateral HRTF may be modified. The specific phase response may be a linear phase response.

The processor may be configured to determine a contralateral group-delay based on an ipsilateral group-delay corresponding to the modified phase response of the first ipsilateral HRTF in a time domain, modify a phase response of the first contralateral HRTF based on the contralateral group-delay, and generate the output audio signal by binaural rendering the input audio signal based on the phase response modified first pair of HRTFs of which phase responses of the first ipsilateral HRTF and the first contralateral are modified, and wherein the modified phase response of the first contralateral HRTF may be a linear phase response.

The processor may be configured to determine the contralateral group-delay based on a head modeling information of the listener.

The processor may be configured to obtain an interaural time difference (ITD) information based on the first pair of HRTFs obtained from the first set of transfer functions, and determine the contralateral group-delay based on the ITD information.

The ipsilateral group-delay and the contralateral group-delay are integer multiples of a sample according to a sampling frequency in the time domain.

The processor may be configured to in the time domain, generate the output audio signal by delaying the input audio signal based on the contralateral group-delay and the ipsilateral group-delay, respectively.

The processor may be configured to generate a final output audio signal based on the phase response modified first pair of HRTFs and an additional audio signal in the time domain, and wherein each group-delay of an ipsilateral and a contralateral of the additional audio signal may be the same as each of the ipsilateral group-delay and the contralateral group-delay, respectively.

The processor may be configured to determine a panning gain based on the position of the virtual sound source with respect to the listener, filter the input audio signal based on the panning gain, and delay the filtered input audio signal based on the ipsilateral group-delay and the contralateral group-delay to generate the additional audio signal.

The processor may be configured to generate the output signal by binaural rendering the input audio signal based on the phase response modified first pair of HRTFs, generate the additional audio signal by filtering the input audio signal based on an additional filter pair including an ipsilateral additional filter and a contralateral additional filter, and generate the final output audio signal by mixing the output audio signal with the additional audio signal. A phase response of the ipsilateral additional filter may be the same as the modified phase response of the first ipsilateral HRTF, and a phase response of the contralateral additional filter may be the same as the modified phase response of the first contralateral HRTF.

A magnitude component of frequency response of each of the ipsilateral additional filter and the contralateral additional filter may be constant. The processor may be configured to determine a panning gain based on the position of the virtual sound source with respect to the listener, generate the additional filter pair with setting the panning gain as the constant magnitude response, and generate the additional audio signal by filtering the input audio signal based on the additional filter pair.

The processor may be configured to generate the additional filter pair based on a size of an object modeled by the virtual sound source and a distance from the listener to the virtual sound source, and generate the additional audio signal by filtering the input audio signal based on the additional filter pair.

A phase response of each of the plurality of HRTFs included in the first set of transfer functions may be the same each other regardless of the position of the plurality of HRTFs. The processor may be configured to obtain at least two pairs of HRTFs among the first set of transfer functions based on the position of the virtual sound source, when the position of the virtual sound source may be a position other than a position corresponding to each of the plurality of HRTFs, and obtain the first pair of HRTFs by interpolating the at least two pairs of HRTFs in a time domain.

The processor may be configured to obtain a second pair of HRTFs including a second ipsilateral HRTF and a second contralateral HRTF, based on the position of the virtual sound source, from a second set of transfer functions other than the first set of transfer functions, modify a phase response of the second ipsilateral HRTF to be the modified phase response of the first ipsilateral HRTF, modify a phase response of the second contralateral HRTF to be the modified phase response of the first contralateral HRTF, and generate the output audio signal based on the phase response modified first pair of transfer functions and the phase response modified second pair of transfer functions.

Advantageous Effects

An audio signal processing device and method according to an embodiment of the present disclosure may reduce the deterioration in sound quality due to the comb-filtering effect occurring in the binaural rendering process. Furthermore, the audio signal processing device and method may reduce the distortion of timbre occurring in the process of binaural rendering an input audio signal based on a plurality of filters to generate an output audio signal.

MODE FOR CARRYING OUT THE INVENTION

Figure 1:
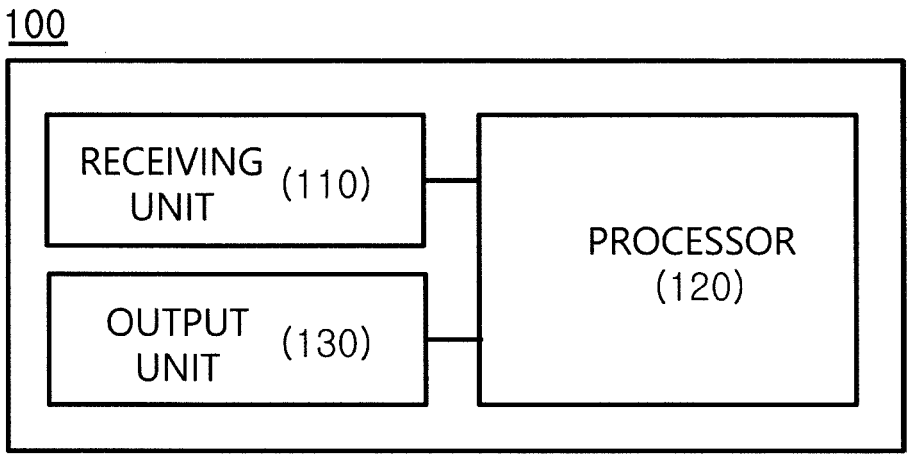
FIG. 1 is a block diagram illustrating a configuration of an audio signal processing device according to an embodiment of the present disclosure.

Hereinafter, embodiments of the present disclosure will be described in detail with reference to the accompanying drawings so that the embodiments of the present disclosure can be easily carried out by those skilled in the art. However, the present disclosure may be implemented in many different forms and is not limited to the embodiments described herein. Some parts of the embodiments, which are not related to the description, are not illustrated in the drawings to clearly describe the embodiments of the present disclosure. Like reference numerals refer to like elements throughout the description.

When it is mentioned that a certain part "includes" or "comprises" certain elements, the part may further include other elements, unless otherwise specified. When it is mentioned that a certain part "includes" or "comprises" certain elements, the part may further include other elements, unless otherwise specified.

The present disclosure relates to a method for binaural rendering an input audio signal to generate an output audio signal. An audio signal processing device according to an embodiment of the present disclosure may generate an output audio signal based on the binaural transfer function pair whose phase response has been changed. The phase response represents the phase component of the frequency response. Further, the audio signal processing device may change a phase response of an initial binaural transfer function pair corresponding to an input audio signal. The device for processing an audio signal according to an embodiment of the present disclosure may mitigate a comb-filtering effect generated in a binaural rendering process by using a transfer function which has an adjusted phase response. In addition, the audio signal processing device may mitigate timbre distortion while maintaining the sound image localization performance of the input audio signal. In this disclosure, the transfer function may include a head-related transfer function (HRTF).

Hereinafter, the present disclosure will be described in detail with reference to the accompanying drawings FIG. 1 is a block diagram illustrating a configuration of an audio signal processing device 100 according to an embodiment of the present disclosure. According to an embodiment, the audio signal processing device 100 may include a receiving unit 110, a processor 120, and an output unit 130. However, not all of the elements illustrated in FIG. 1 are essential elements of the audio signal processing device. The audio signal processing device 100 may additionally include elements not illustrated in FIG. 1. Furthermore, at least some of the elements of the audio signal processing device 100 illustrated in FIG. 1 may be omitted.

The receiving unit 110 may receive an audio signal. The receiving unit 110 may receive an input audio signal input to the audio signal processing device 100. The receiving unit 110 may receive an input audio signal to be binaural rendered by the processor 120. Here, the input audio signal may include at least one of an ambisonics signal, an object signal or a channel signal. Here, the input audio signal may be one object signal or mono signal. The input audio signal may be a multi-object or multi-channel signal. According to an embodiment, when the audio signal processing device 100 includes a separate decoder, the audio signal processing device 100 may receive an encoded bitstream of the input audio signal.

According to an embodiment, the receiving unit 110 may be equipped with a receiving means for receiving the input audio signal. For example, the receiving unit 110 may include an audio signal input port for receiving the input audio signal transmitted by wire. Alternatively, the receiving unit 110 may include a wireless audio receiving module for receiving the audio signal transmitted wirelessly. In this case, the receiving unit 110 may receive the audio signal transmitted wirelessly by using a Bluetooth or Wi-Fi communication method.

The processor 120 may control the overall operation of the audio signal processing device 100. The processor 120 may control each component of the audio signal processing apparatus 100. The processor 120 may perform operations and processes for various data and signals. The processor 120 may be implemented as hardware in the form of a semiconductor chip or electronic circuit, or may be implemented as software that controls hardware. The processor 120 may be implemented as a combination of hardware and software. For example, the processor 120 may control operations of the receiving unit 110 and the output unit 130 by executing at least one program. Furthermore, the processor 120 may execute at least one program to perform the operations of the audio signal processing device 100 described below with reference to FIGS. 2 to 30.

For example, the processor 120 may generate an output audio signal. The processor 120 may generate the output audio signal by binaural rendering the input audio signal received through the receiving unit 110. The processor 120 may output the output audio signal through the output unit 130 that will be described later. According to an embodiment, the output audio signal may be a binaural audio signal. For example, the output audio signal may be a 2-channel audio signal representing the input audio signal as a virtual sound source located in a three-dimensional space. The processor 120 may perform binaural rendering based on a transfer function pair that will be described later. The processor 120 may perform binaural rendering in a time domain or a frequency domain.

According to an embodiment, the processor 120 may generate a 2-channel output audio signal by binaural rendering the input audio signal. For example, the processor 120 may generate the 2-channel output audio signal corresponding to both ears of a listener, respectively. Here, the 2-channel output audio signal may be a binaural 2-channel output audio signal. The processor 120 may generate an audio headphone signal represented in three dimensions by binaural rendering the above-mentioned input audio signal.

According to an embodiment, the processor 120 may generate the output audio signal by binaural rendering the input audio signal based on a transfer function pair. The transfer function pair may include at least one transfer function. For example, the transfer function pair may include a pair of transfer functions corresponding to both ears of the listener. The transfer function pair may include an ipsilateral transfer function and a contralateral transfer function. In detail, the transfer function pair may include an ipsilateral head related transfer function (HRTF) corresponding to a channel for an ipsilateral ear and a contralateral HRFT corresponding to a channel for a contralateral ear. Hereinafter, for convenience of explanation, if there is no special description, transfer function (or HRTF) is used as a term indicating at least one transfer function included in the transfer function (or HRTF) pair.

According to one embodiment, the processor 120 may determine a transfer function pair based on a position of a virtual sound source corresponding to an input audio signal. In this case, the processor 120 may obtain the transfer function pair from another apparatus (not shown) other than the audio signal processing device 100. For example, the processor 120 may receive at least one transfer function from a database that includes a plurality of transfer functions. The database may be an external device that stores a set of transfer functions including a plurality of transfer function pairs. In this case, the audio signal processing device 100 may include a separate communication unit (not shown) for requesting a transfer function to the database and receiving information about the transfer function from the database. The processor 120 may obtain a transfer function pair corresponding to the input audio signal based on a set of transfer functions stored in the audio signal processing device 100. The processor 120 may binaurally render the input audio signal based on the acquired transfer function pair to generate an output audio signal.

According to an embodiment, post-processing may be additionally performed on the output audio signal of the processor 120. The post-processing may include crosstalk cancellation, dynamic range control (DRC), sound volume normalization, peak limitation, etc. Furthermore, the post-processing may include frequency/time domain conversion for the output audio signal of the processor 120. The audio signal processing device 100 may include a separate post-processing unit for performing the post-processing, and according to another embodiment, the post-processing unit may be included in the processor 120.

The output unit 130 may output the output audio signal. The output unit 130 may output the output audio signal generated by the processor 120. The output unit 130 may include at least one output channel. Here, the output audio signal may be a 2-channel output audio signal respectively corresponding to both ears of the listener. The output audio signal may be a binaural 2-channel output audio signal. The output unit 130 may output a 3D audio headphone signal generated by the processor 120.

According to an embodiment, the output unit 130 may be equipped with an output means for outputting the output audio signal. For example, the output unit 130 may include an output port for externally outputting the output audio signal. Here, the audio signal processing device 100 may output the output audio signal to an external device connected to the output port. The output unit 130 may include a wireless audio transmitting module for externally outputting the output audio signal. In this case, the output unit 130 may output the output audio signal to an external device by using a wireless communication method such as Bluetooth or Wi-Fi. The output unit 130 may include a speaker. Here, the audio signal processing device 100 may output the output audio signal through the speaker. Furthermore, the output unit 130 may additionally include a converter (e.g., digital-to-analog converter, DAC) for converting a digital audio signal to an analog audio signal.

A binaural rendered audio signal in a virtual reality may be combined with additional signals to increase reproducibility. Accordingly, an audio signal processing device may generate a binaural filter that binaural renders an input audio signal based on a plurality of filters. In addition, the audio signal processing device may synthesize the filtered audio signals based on the plurality of filters. In this case, the quality of the final output audio signal may be degraded due to the difference between the phase characteristics of a frequency response of the plurality of filters (i.e., the time delay difference in the time domain). This is because the timbre of the output audio signal may be distorted due to the comb-filtering effect.

Thus, the audio signal processing device may modify the phase response of the position-specific HRTF corresponding to each specific position with respect to the listener. For example, the location-specific HRTF may include an HRTF corresponding to each location on the unit sphere with respect to the listener. According to an embodiment of the present disclosure, the audio signal processing device may binaural render the input audio signal by using a set of transfer functions of which the phase responses of the ipsilateral HRTFs are modified to coincide with each other. The audio signal processing device may synchronize each of the phase responses of the ipsilateral HRTFs for each position to have the same linear phase response. In addition, the audio signal processing device may linearize each of the phase responses of the position-specific contralateral HRTFs.

Figure 2:
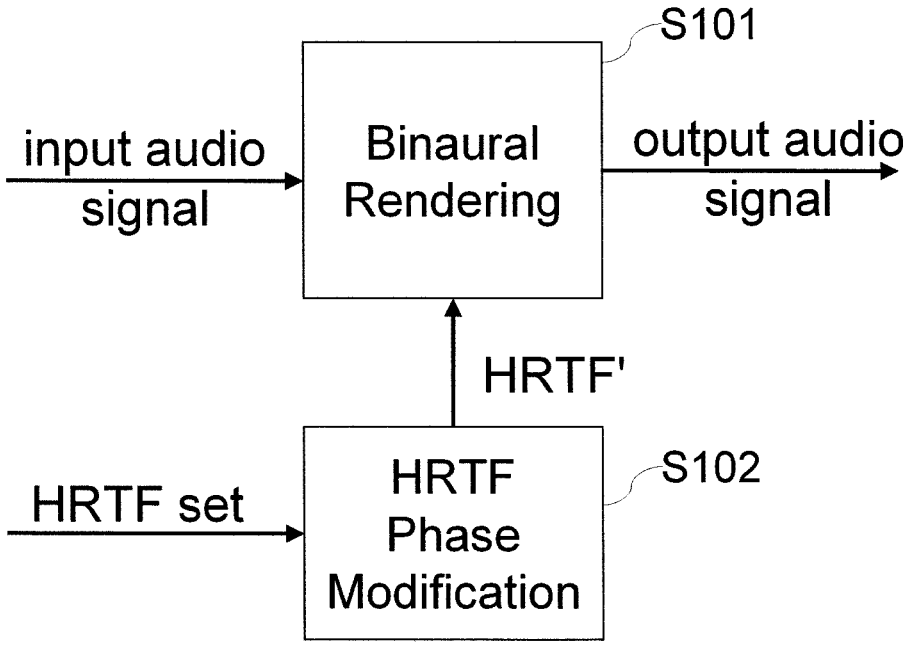
FIG. 2 is a block diagram illustrating operations of an audio signal processing device according to an embodiment of the present disclosure.

Hereinafter, an operation method of an audio signal processing device according to an embodiment of the present disclosure will be described with reference to FIG. 2. FIG. 2 is a block diagram showing the operation of the audio signal processing device according to an embodiment of the present disclosure. According to an embodiment, the audio signal processing device may binaural render an input audio signal (S101) to generate an output audio signal. The audio signal processing device may binaural render the input audio signal based on a HRTF pair obtained from a set of transfer functions. Specifically, the audio signal processing device may obtain a set of HRTFs including a plurality of HRTFs corresponding to each specific position with respect to a listener. The audio signal processing device may obtain an HRTF set measured by an audio signal processing device or an external apparatus. In the present disclosure, "head-related transfer function (HRTF)" may be used to refer to a binaural transfer function used for binaural rendering an input audio signal. The binaural transfer function may include at least one of an Interaural Transfer Function (ITF), a Modified ITF (MITF), a Binaural Room Transfer Function (BRTF), a Room Impulse Response (RIR), a Binaural Room Impulse Response (BRIR), a Head Related Impulse Response (HRIR) or modified/edited data thereof, but the present disclosure is not limited thereto. For example, the binaural transfer function may include a secondary binaural transfer function obtained by linearly combining a plurality of binaural transfer functions. The HRTF may be a Fast Fourier Transform (FFT) of the HRIR, but the conversion method is not limited thereto.

The HRTF may be measured in an anechoic room. The HRTF may also include information on the HRTF estimated by simulation. The simulation methods used to estimate HRTF may be at least one of spherical head model (SHM), snowman model, finite-difference time-domain method (FDTDM), or boundary element method (BEM). In this case, the spherical head model represents a simulation technique in which a human head is assumed to be spherical. In addition, the snowman model represents a simulation technique in which the head and body are assumed to be spherical.

In addition, the set of HRTFs may include HRTF pairs defined corresponding to the angles at predetermined angular intervals. For example, the predetermined angular interval may be 1 degree or 10 degrees, but the present disclosure is not limited thereto. In the present disclosure, angles may include azimuths, elevations, and combinations thereof. For example, the set of HRTFs may include a head transfer function corresponding to each combination of the azimuths and elevations with respect to the center of sphere having the predetermined value as radius of the sphere. In addition, in the present disclosure, any coordinate system that defines the azimuth and the elevation may be either a vertical polar coordinate system (VPC) or an interaural polar coordinate system (IPC). Further, the audio signal processing device may use pairs of HRTFs defined for every predetermined angular interval to obtain a pair of HRTFs corresponding to an angle between predetermined angular intervals. This will be described later with reference to FIGS. 10 to 11.

According to an embodiment, the audio signal processing device may obtain a set of transfer functions (HRTF' set) whose phase responses are modified. For example, the audio signal processing device may generate the set of transfer function (HRTF' set) whose phase responses are modified from an obtained set of transfer function (HRTF set). The audio signal processing device may obtain the set of transfer function (HRTF' set) or a pair of HRTFs whose phase response is modified from an external device. In addition, the audio signal processing device may binaural render an input audio signal based on the set of transfer functions (HRTF' set) whose phase response is modified.

For example, the audio signal processing device may obtain HRTF' whose phase response has been modified (S102). Specifically, the audio signal processing device may obtain pairs of HRTFs corresponding to the input audio signal from the set of transfer functions. For example, the audio signal processing device may obtain at least one pair of HRTFs that simulate the input audio signal based on a position of a virtual sound source corresponding to the input audio signal with respect to a listener. When there are a plurality of virtual sound sources corresponding to the input audio signal, a plurality of HRTF pairs corresponding to the input audio signals may be provided. Further, the audio signal processing device may obtain a plurality of HRTF pairs based on the position of the virtual sound source. For example, when the size of an object simulated by the virtual sound source is equal to or larger than a predetermined size, the audio signal processing device may obtain an output audio signal based on a plurality of HRTF pairs. Further, the pair of HRTFs may be a pair composed of an ipsilateral HRTF and a contralateral HRTF corresponding to different positions. For example, the audio signal processing device may obtain the ipsilateral HRTF and the contralateral HRTF corresponding to different positions based on the position of the virtual sound source corresponding to the input audio signal.

Next, the audio signal processing device may modify the phase response of the HRTF pair. In addition, the audio signal processing device may receive a set of HRTF' whose phase response has been modified from an external device. In this case, the audio signal processing device may obtain the HRTF' pair whose phase response has modified from the modified set of HRTF's. Next, the audio signal processing device may binaural render the input audio signal based on the HRTF' pair whose phase response has been modified. At least some of the operations of the audio signal processing device described with reference to FIGS. 3 to 30 may be performed by another device. For example, modifying a phase response for each of transfer functions described below may be performed through an external device. In this case, the audio signal processing device may receive the transfer functions having the modified phase characteristics from an external apparatus. Further, the audio signal processing device may generate an output audio signal based on the transfer functions having the modified phase characteristics.

Hereinafter, a method for modifying a phase response of each of a plurality of HRTFs included in an obtained set of HRTFs according to an embodiment of the present disclosure will be described with reference to FIGS. 3 to 9. For convenience, a processing method for a pair among the plurality of HRTF pairs included in the obtained set of HRTFs will be described as an example. The operation method of the audio signal processing device described below may be applied to the entire HRTF pairs included in the set of HRTFs.

Figure 3:
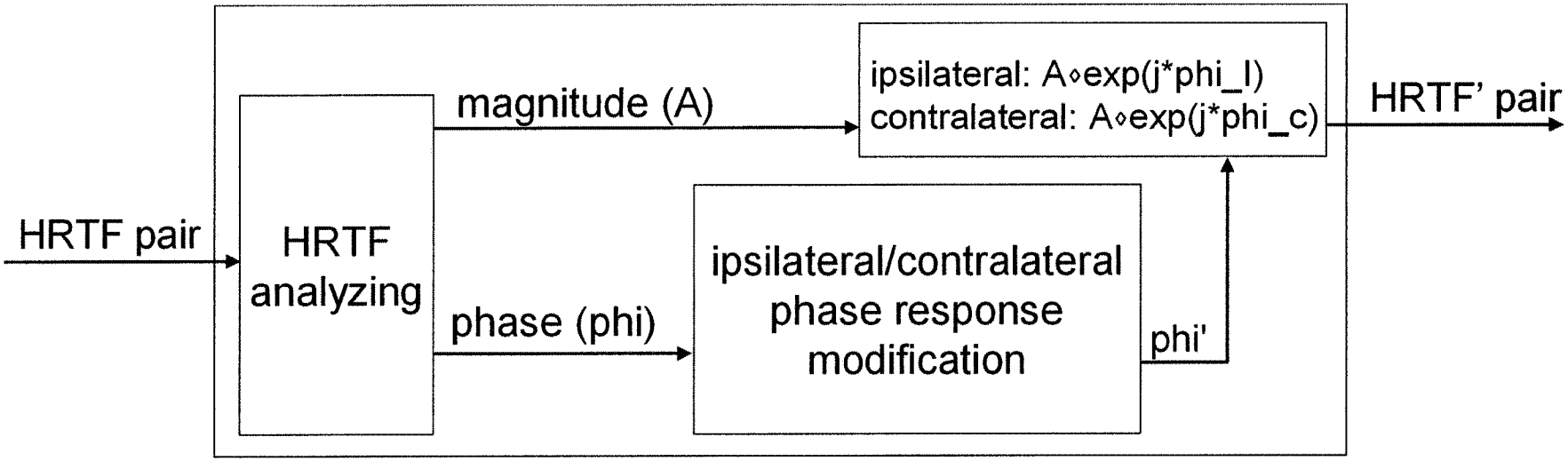
FIG. 3 is a diagram specifically illustrating a method for an audio signal processing device according to an embodiment of the present disclosure to modify a phase response of an original HRTF pair.

FIG. 3 is a diagram specifically illustrating a method for an audio signal processing device according to an embodiment of the present disclosure to modify a phase response of an original HRTF pair. In this case, the original HRTF pair may represent a measured HRTFs. According to an embodiment, the audio signal processing device may analyze the obtained original HRTF pair. The audio signal processing device may obtain the original HRTF pair based on a position of a virtual sound source corresponding to an input audio signal from the aforementioned HRTF set. In this case, the set of HRTF set may include an HRTF pair corresponding to each specific position with respect to the listener. Further, the HRTF pair may include an ipsilateral HRTF and a contralateral HRTF. Hereinafter, for convenience, the HRTF without limitation on the ipsilateral or the contralateral may represent any one of the ipsilateral HRTF and the contralateral HRTF. Referring to FIG. 3, the audio signal processing device may process a magnitude response (A) and the phase response (phi) of each of the ipsilateral and the contralateral HRTFs separately. The magnitude response represents the magnitude component of the frequency response. The phase response represents the phase component of the frequency response.

Next, the audio signal processing device may obtain a final HRTF pair by modifying the phase response of the original HRTF. The modification of the phase response in this disclosure may include a replacement, substitution or correction of the phase value corresponding to some frequency bins, of the phase response. Alternatively, the phase response for some of the plurality of HRTFs included in the set of HRTFs may be maintained. Specifically, the audio signal processing device may obtain a final ipsilateral HRTF by setting the phase response of an original ipsilateral HRTF as a common ipsilateral phase response. Here, the common ipsilateral phase response may be a single phase response for a plurality of ipsilateral HRTFs included in a set of HRTFs.

For example, the audio signal processing device may set each of the phase responses of the ipsilateral HRTFs according to each specific position with respect to the listener to be a specific phase response that is same regardless of the position corresponding to each of the ipsilateral HRTFs. The audio signal processing device may match the phase response of the final ipsilateral HRTF with the common ipsilateral phase response that is the same regardless of the position of the virtual sound source corresponding to the input audio signal. In the case of a human auditory sense, a position of a sound source may be recognized based on the difference in sound volume and the difference in arrival time, between both ears of a human being. Accordingly, the audio signal processing device may fix the phase response of either the ipsilateral or the contralateral in a position-independent response. In this way, the audio signal processing device may reduce the amount of data to be stored. For example, the audio signal processing device may fix a phase response of the ipsilateral HRTF. Because the energy of the audio signal is larger on an ipsilateral than on a contralateral. Further, the audio signal processing device may set phase responses of the non-fixed side, based on the difference between the phase responses of the ipsilateral HRTF and the contralateral HRTF included in the HRTF pair for each position. According to an embodiment, the common ipsilateral phase response may be a linear response with linear characteristics. This will be described later with reference to FIGS. 4 and 5.

Further, the audio signal processing device may modify a phase response of an original contralateral HRTF to obtain a final contralateral HRTF. The audio signal processing device may obtain a contralateral phase response for the final contralateral HRTF based on an interaural phase difference (IPD) representing a phase difference between the ipsilateral and the contralateral. For example, the audio signal processing device may determine the contralateral phase response based on the phase response of the final ipsilateral HRTF.

Specifically, the audio signal processing device may obtain an IPD corresponding to the input audio signal based on IPDs of each specific position with respect to the listener. The audio signal processing device may calculate the phase difference between the original ipsilateral HRTF and the original contralateral HRTF to obtain the IPD corresponding to the input audio signal. The audio signal processing device may obtain the contralateral phase response based on the difference between the phase response of the ipsilateral HRTF and the contralateral HRTF for each frequency bin. Meanwhile, the phase response deformation of the HRTF may be performed in the time domain. For example, the audio signal processing device may apply a group-delay to the HRIR converted from the HRTF. This will be described later with reference to FIGS. 6 to 9. Next, the audio signal processing device may generate the final HRTF pair (HRTF' pair) based on the magnitude response A and the modified phase response phi' processed separately from each other. In this case, the final HRTF pair may be expressed in the form of a complex number (A*Exp (j*phi_l), A*Exp (j*phi_c)).

Meanwhile, a slop of the phase response of the original ipsilateral HRTF included in the original set of HRTFs may not be constant for each frequency. Because of measurement errors or over fitting to a subject, the phase response of the original HRTF is less likely to be an ideal linear phase response. In this case, the time delay of HRTF for each frequency bin varies in the time domain due to the difference between phase values for each frequency bin, so that an additional distortion of the timbre may occur. According to an embodiment, the audio signal processing device may generate an output audio signal based on the ipsilateral HRTF whose phase characteristics are linearized in a frequency domain. In the embodiment described above with reference to FIG. 3, the audio signal processing device may linearize the common ipsilateral phase response for the plurality of ipsilateral HRTFs. That is, the audio signal processing device may match the time delay of the frequency bin of the HRTF. Accordingly, the audio signal processing device may reduce the timbre distortion caused by different time delay for each frequency component. Hereinafter, a method of linearizing the phase response of the HRTF will be described with reference to FIGS. 4 to 5.

Figure 4:
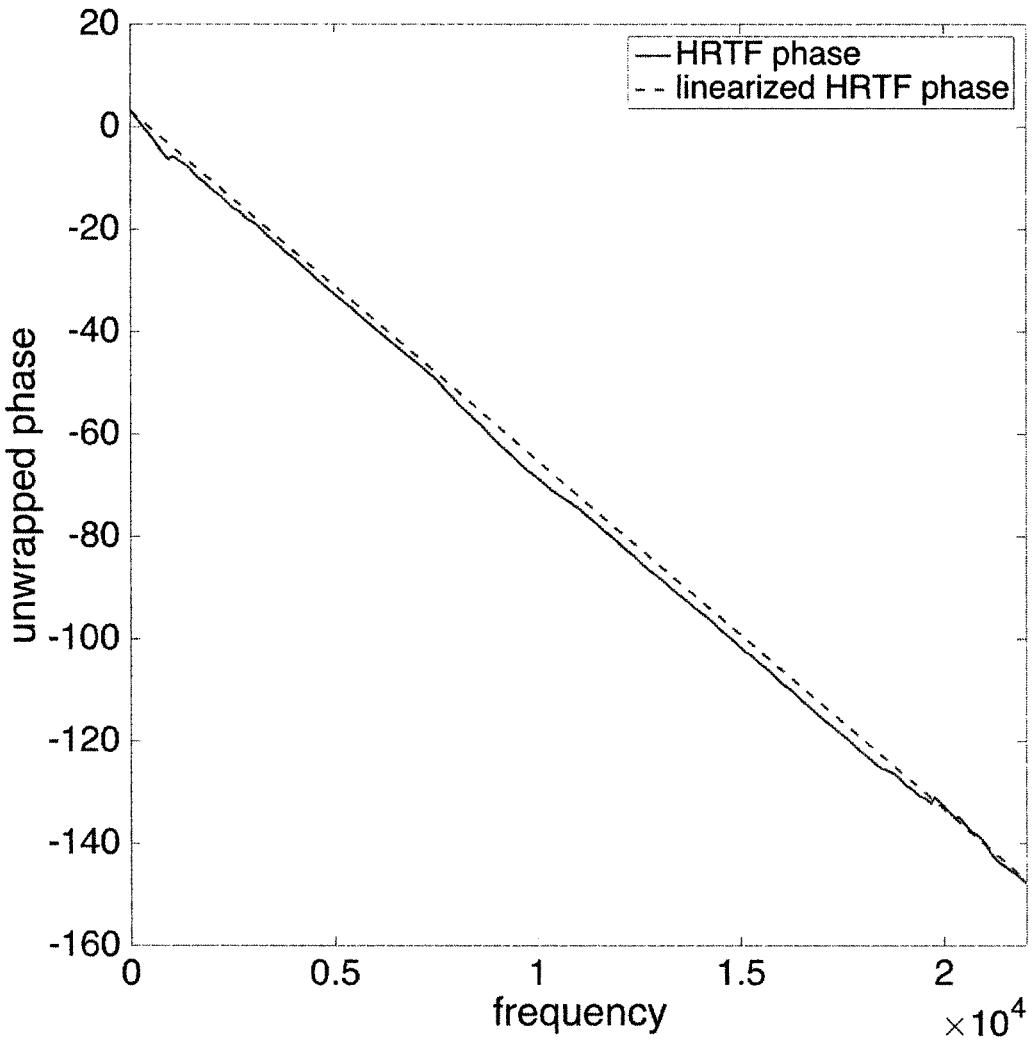
FIG. 4 is a diagram illustrating an original phase response of HRTF and a phase response linearized from the corresponding original phase response.

FIG. 4 is a diagram illustrating an original phase response of HRTF and a phase response linearized from the corresponding original phase response. In FIG. 4, the original phase response of the HRTF is shown in the form of an unwrapping phase response. The audio signal processing device may linearize the phase response of the HRTF by using the unwrapping phase response. Referring to FIG. 4, the audio signal processing device may approximate the phase response of the HRTF to a linear phase response by connecting a phase value of the HRTF corresponding to a DC (direct current) frequency bin and a phase value of the HRTF corresponding to a Nyquist frequency bin. Specifically, the audio signal processing device may linearize the phase response of HRTF as shown in Equation 1.

$$\text{phi_unwrap,lin}[k]=(\text{phi_unwrap}[HN]-\text{phi_unwrap}[0])/HN*k+\text{phi_unwrap}[0],\ \text{where } k \text{ is an integer and } 0\le k\le HN. \quad \text{[Equation 1]}$$

In Equation 1, k denotes an index of a frequency bin. Also, HN denotes the Nyquist frequency bin, and phi_unwrap [HN] denotes an unwrapping phase value at the Nyquist frequency bin. phi_unwrap [0] denotes an unwrapping phase value corresponding to frequency bin DC, and phi_unwrap, lin [k] represents a linearized unwrapping phase value corresponding to frequency bin k. As in Equation 1, the audio signal processing device may obtain a phase value for each frequency bin by using the linear approximated slope of the phase response. The audio signal processing device may wrap the unwrapping phase response so as to be a value between $(-\pi, \pi)$ in a phase-axis to obtain the wrapping phase response. In addition, as in FIG. 3, the audio signal processing device may obtain the final HRTF based on the separately processed magnitude response and wrapping phase response.

Figure 5:
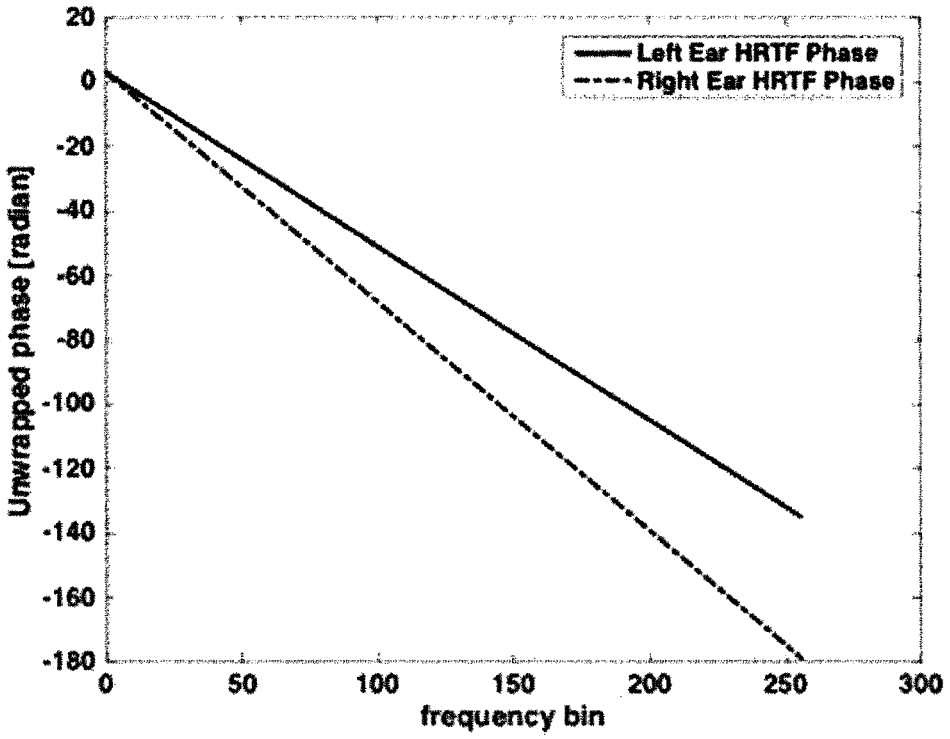
FIG. 5 shows a linearized phase response of each of the left and right HRTFs included in HRTF pair.

FIG. 5 shows a linearized phase response of each of left and right HRTFs included in an HRTF pair. The left HRTF may be an ipsilateral HRTF, and the right HRTF may be a contralateral HRTF. A group-delay of an ipsilateral audio signal is shorter, and thus an absolute value of a slope of a phase response of the ipsilateral HRTF may be smaller than that of the contralateral HRTF. In FIG. 5, the difference (IPD [k]) of phase values for each frequency bin (k) between the left and right HRTFs may be denoted by Equation 2. Equation 2 denotes the IPD when the phase responses of the left and right HRTFs is linearized. In Equation 2, phi_unwrap, lin, left [k] and phi_unwrap, lin, right [k] denote the unwrapping phase values of the left and right HRTFs for each frequency bin k, respectively.

$$\text{IPD}[k]=\text{phi_unwrap,lin,left}[k]-\text{phi_unwrap,lin,right}[k] \quad \text{[Equation 2]}$$

In FIG. 5, the slope difference between the phase response of the left HRTF and the phase response of the right HRTF may be represented as a group-delay difference in a time domain. For example, the greater the slope difference between the phase responses of the ipsilateral HRTF and the contralateral HRTF, the greater the difference between the ipsilateral group-delay and the contralateral group-delay. Further, when the audio signal processing device applies the group-delay to the HRIR, the phase response of the corresponding HRTF may be a linear phase response. Here, the group-delay may represent a delay time that commonly delays filter coefficients included in the HRIR in the time domain. Further, when the phase response of the HRTF is a zero-phase response, the audio signal processing device may apply the determined group-delay without any modification to the HRIR. Hereinafter, a method for obtaining a contralateral group-delay corresponding to a linearized contralateral phase response will be described.

As described above, the audio signal processing device according to an embodiment of the present disclosure may perform at least part of the process of modifying the phase response of the HRTF in the time domain. For example, the audio signal processing device may convert HRTF to HRIR, which is a response in the time domain. In this case, the phase response of the HRTF may be a zero-phase response. In the case of the zero-phase response, the amount of calculation required for audio signal processing may be reduced as described later. The audio signal processing device may perform an inverse fast Fourier transform (IFFT) on the HRTF to obtain the HRIR. Next, the audio signal processing device may modify the phase response of the HRTF by time delaying an ipsilateral HRIR and a contralateral HRIR based on the group-delay, respectively. Also, when converting the group-delay applied HRIR to HRTF, which is a frequency domain response, a phase response of the HRTF may be the linear phase response described above.

Specifically, the audio signal processing device may generate a final ipsilateral HRIR by delaying the ipsilateral HRIR based on the ipsilateral group-delay in the time domain. In this case, the ipsilateral group-delay may be a value independent of a position of a virtual sound source simulated by the HRTF. For example, the ipsilateral group-delay may be a value set based on frame size of the input audio signal. Further, the frame size may indicate the number of samples included in one frame. Accordingly, the audio signal processing device may prevent the filter coefficient of the HRIR out of the frame size based on the time '0'. The audio signal processing device may apply the same ipsilateral group-delay to a plurality of ipsilateral HRIRs included in a set of HRIRs. The audio signal processing device may obtain the final ipsilateral HRIR by delaying the ipsilateral HRIR based on the ipsilateral group-delay. Further, the audio signal processing device may convert the HRIR to which the ipsilateral group-delay is applied to a response of a frequency domain to obtain the final ipsilateral HRTF.

In addition, the audio signal processing device may generate a final contralateral HRIR by delaying the contralateral HRIR based on the contralateral group-delay in the time domain. In this case, the contralateral group-delay may be a value set based on the position of the virtual sound source simulated by the contralateral HRTF, unlike the ipsilateral group-delay. This is because the interaural time difference (ITD) may be varied depending on the position of the virtual sound source corresponding to the input audio signal with respect to the listener, which indicates the arrival time difference of the audio signal between the ipsilateral and the contralateral. The audio signal processing device may determine the contralateral group-delay for applying to the contralateral HRIR based on the ITD for each specific position with respect to the listener. In this case, the contralateral group-delay may be an ITD time for the position of the virtual sound source corresponding to the input audio signal with respect to the listener added to the ipsilateral group-delay time.

Also, the audio signal processing device may convert the HRIR to which contralateral group-delay is applied to a response of the frequency domain to obtain a final contralateral HRTF. In this case, as the slope of the phase response of the contralateral HRTF increases, the contralateral group-delay value be increased. Further, the audio signal processing device may determine different contralateral group-delay for each specific position with respect to the listener, based on a group-delay of an ipsilateral HRIR and a ITD. Hereinafter, a method of obtaining the ITD by the audio signal processing device according to an embodiment of the present disclosure will be described in detail with reference to FIGS. 6 to 9.

According to an embodiment, the audio signal processing device may obtain the ITD (or IPD) based on the correlation between the ipsilateral HRIR (or HRTF) and the contralateral HRIR (or HRTF). In this case, the HRIR may be a personalized HRIR. This is because cross-correlation between ipsilateral HRIR and contralateral HRIR (or HRTF) may vary depending on the head model of the listener. The audio signal processing device may also obtain the ITD by using personalized HRIRs that is a measured response based on the head model of the listener. The audio signal processing device may calculate the ITD based on the cross-correlation between the ipsilateral HRIR and the contralateral HRIR as shown in Equation 3 below.

$$\text{maxDelay}=\text{xcorr}(\text{HRIR_cont},\text{HRIR_ipsil}),$$

$$\text{ITD}=\text{abs}(\text{maxDelay}-\text{HRIR_length}) \qquad \text{[Equation 3]}$$

In Equation 3, xcorr(x,y) is a function of outputting an index of the delay time (maxDelay) corresponding to the highest cross-correlation among cross-correlations between x and y for each delay time. In Equation 3, HRIR_cont and HRIR_ipsil indicates the contralateral HRIR and the ipsilateral HRIR, respectively, and HRIR_length indicates the length of the HRIR filter in the time domain.

Figure 6:
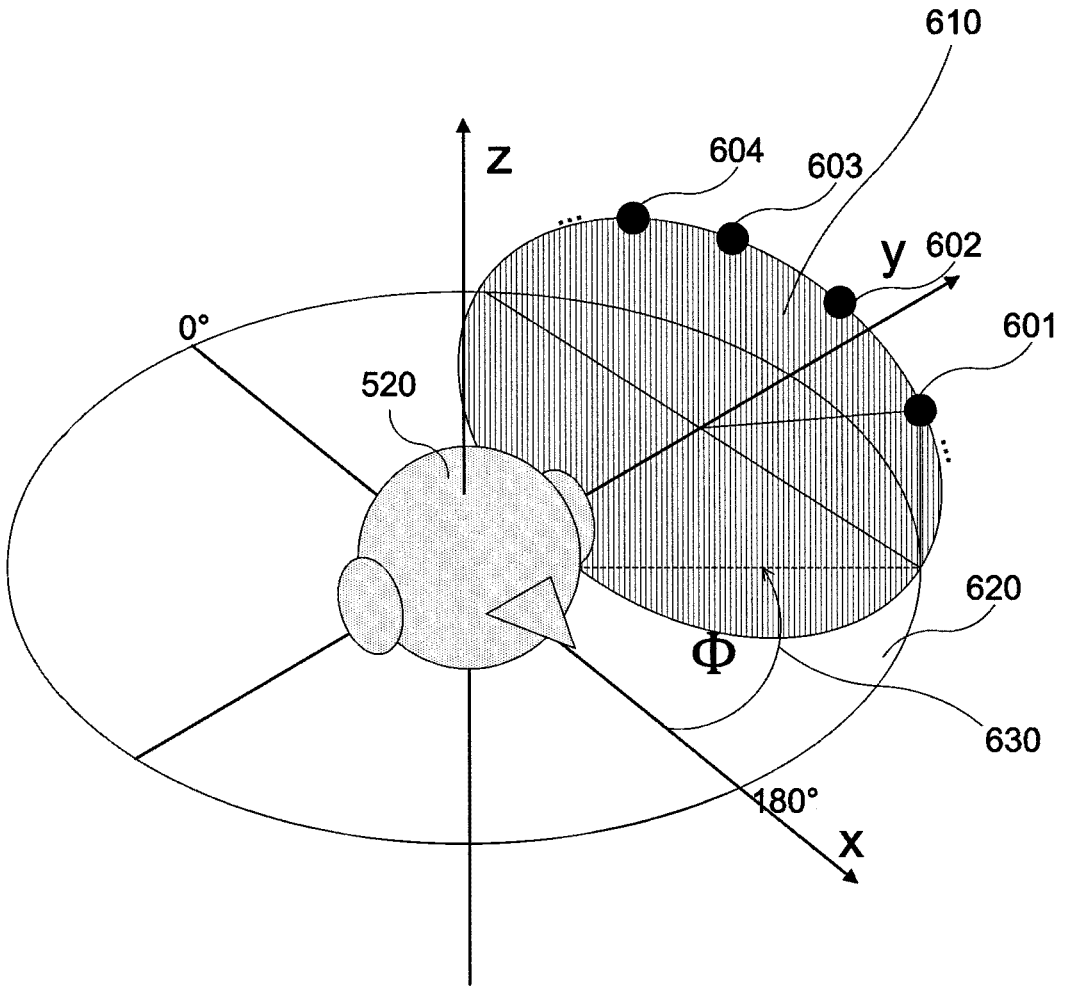
FIG. 6 and FIG. 7 are diagrams illustrating a method for an audio signal processing device to obtain an ITD for an azimuth in a interaural polar coordinate (IPC) system according to an embodiment of the present disclosure.
Figure 7:
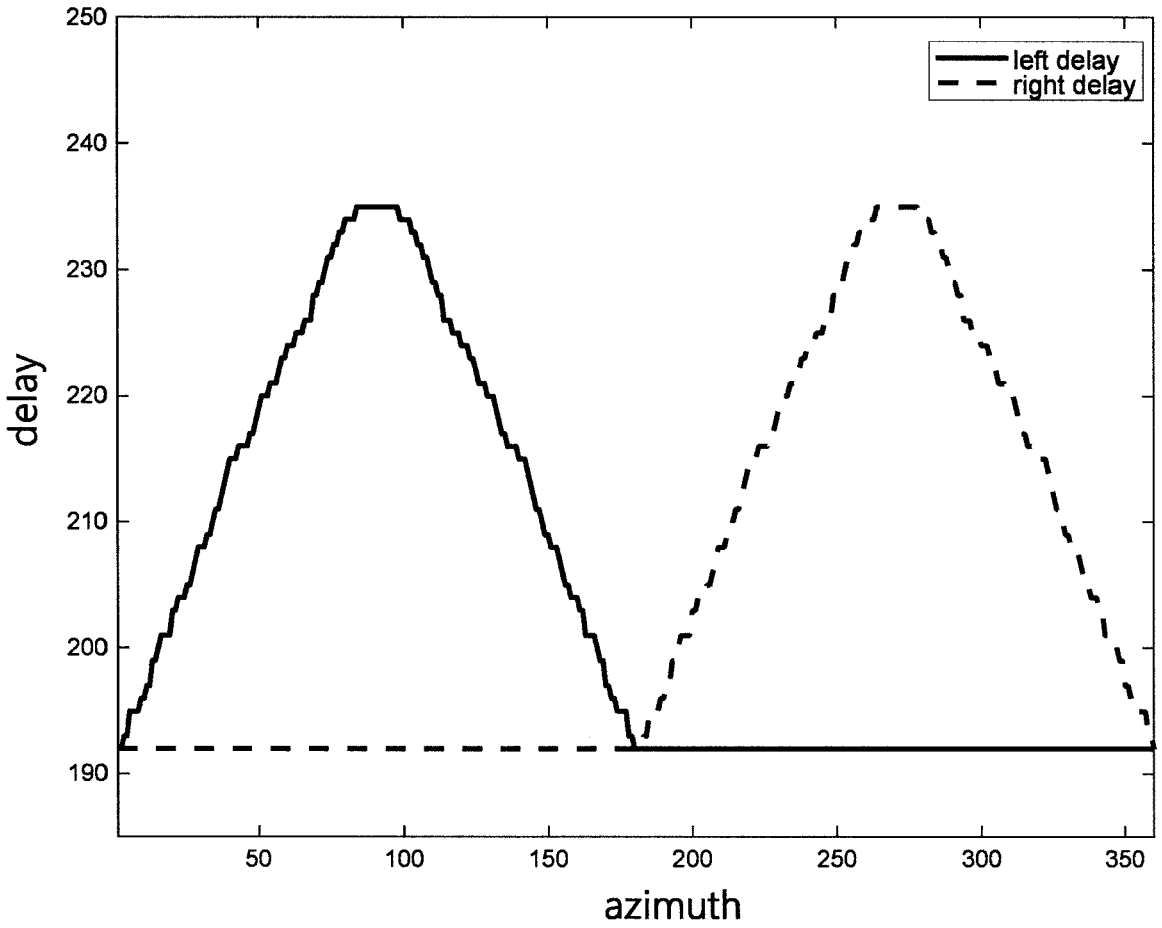

FIGS. 6 and 7 are diagrams illustrating a method for an audio signal processing device to obtain an ITD for an azimuth in a interaural polar coordinate (IPC) system according to an embodiment of the present disclosure. According to an embodiment, the audio signal processing device may obtain an ITD corresponding to a sagittal plane (constant azimuth plane) 610 for the azimuth angle in the IPC. In this case, the sagittal plane may be a plane parallel to the median plane. Also, the median plane may be a plane perpendicular to the horizontal plane 620 and having the same center as the horizontal plane.

Specifically, the audio signal processing device includes an ITD for elevation corresponding to each of a plurality of points 601, 602, 603, and 604 where a sagittal plane corresponding to a first azimuth angle 630 and a unit sphere centering on the listener meet, may be obtained. In this case, the plurality of points 601, 602, 603, and 604 may have the same azimuth and different elevations in the IPC. Further, the audio signal processing device may obtain a common ITD corresponding to the first azimuth 630 based on ITD for each elevation. For example, the audio signal processing device may use any one of an average value, a median value, and a mode value of ITD for each elevation as a group ITD corresponding to the first azimuth angle 630. In this case, the audio signal processing device may determine a contralateral group-delay that equally applies to a plurality of contralateral HRTFs corresponding to the first azimuth angle 630 and having different elevation angles based on the group ITD.

Equation 4 represents an operation process of the audio signal processing device when the audio signal processing device uses the median value of ITD for each elevation as the group ITD.

$$t_cont=median\{argmax_t(xcorr(HRIR_cont(n,a,e), HRIR_ipsil(n,a,e)))-HRIR_length\}+t_pers+t_ipsil \quad \text{[Equation 4]}$$

In Equation 4, xcorr(x,y) is a function of outputting an index of the delay time (maxDelay) corresponding to the highest cross-correlation among cross-correlations between x and y for each delay time. In Equation 4, HRIR_cont and HRIR_ipsil indicates the contralateral HRIR and the ipsilateral HRIR, respectively, and HRIR_length indicates the length of the HRIR filter in the time domain. t_pers indicates an additional delay for personalization for each listener, 'a' indicates an azimuth index, 'e' indicates an elevation index, and t_ipsil indicates an ipsilateral group-delay. FIG. 7 is an example showing the group-delay applied to each of the left and right HRTFs according to Equation 4 according to the azimuth. In FIG. 7, when the position of the virtual sound source is from 0 degree to 180 degrees of azimuth, the left side of the listener corresponds to the contralateral, and the right side of the listener corresponds to the ipsilateral. When the position of the virtual sound source is from 180 degrees to 360 degrees, the left side of the listener corresponds to the ipsilateral and the right side of the listener corresponds to the contralateral.

According to an embodiment, the audio signal processing device may obtain a contralateral phase response based on the head modeling information of the listener. This is because the ITD may vary depending on the head shape of the listener. The audio signal processing device may use the head modeling information of the listener to determine a personalized contralateral group-delay. For example, the audio signal processing device may determine the contralateral group-delay based on the head modeling information of the listener and the position of the virtual sound source corresponding to the input audio signal with respect to the listener.

Figure 8:
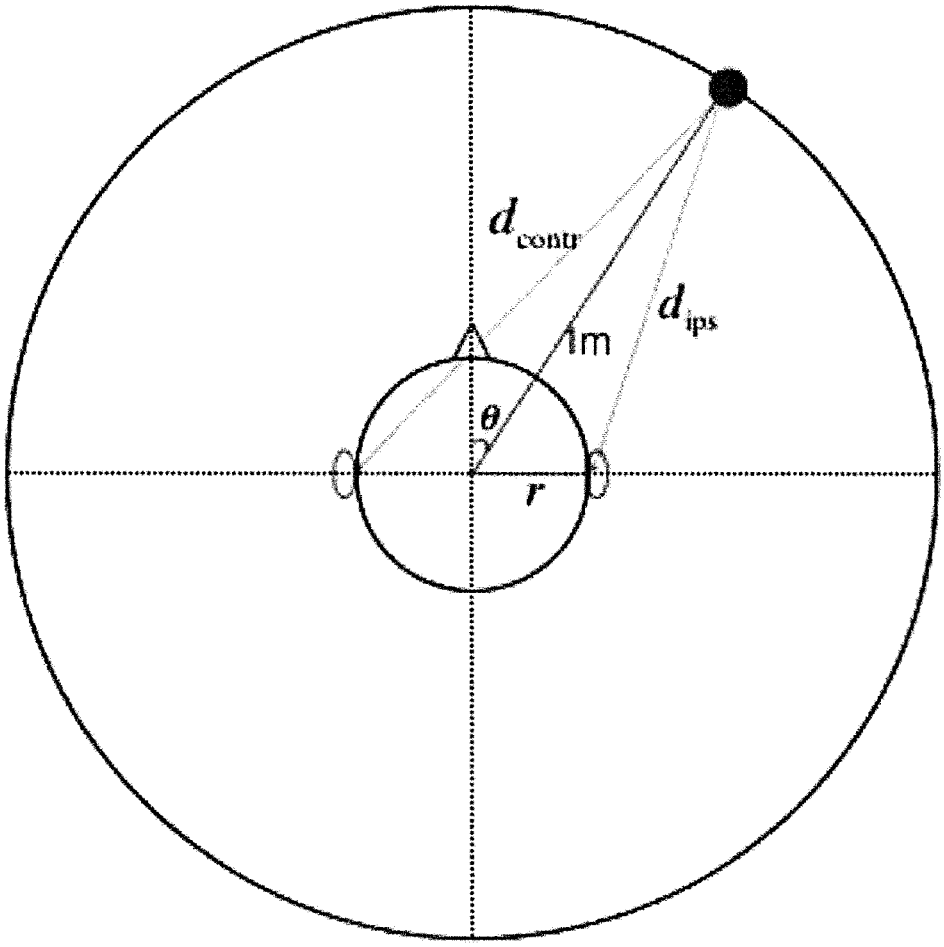
FIG. 8 is a diagram illustrating a method for an audio signal processing device to obtain an ITD by using head modeling information of a listener according to an embodiment of the present disclosure.

FIG. 8 is a diagram illustrating a method for an audio signal processing device to obtain an ITD by using head modeling information of a listener according to an embodiment of the present disclosure. The head modeling information may include at least one of radius of the approximated sphere based on the head of the listener (i.e., head size information) and the positions of both ears of the listener, but the present disclosure is not limited thereto. The audio signal processing device may obtain the ITD based on at least one of the head size information of the listener, the position of the virtual sound source based on the head direction of the listener, and the distance between the listener and the virtual sound source. Here, the distance between the listener and the virtual sound source may be the distance from the center of the listener to the sound source, or the distance from ipsilateral ear/contralateral ear of the listener to the sound source. Specifically, the time (tau_ipsil, tau_cont) at which sound reaches from the virtual sound source to the ipsilateral ear and the contralateral ear of the listener, respectively, may be represented as Equation 5.

$$d_cont=sqrt((1m)^2+r^2-2*r*cos(90+abs(theta)))$$

$$tau_cont=d_cont/c$$

$$d_ipsil=sqrt((1m)^2+r^2-2*r*cos(90-abs(theta)))$$

$$tau_ipsil=d_ipsil/c, \quad \text{[Equation 5]}$$

where c is the sound velocity (343 m/s), and $-90<theta<90$.

In Equation 5, 'r' may be the radius of the approximated sphere based on the head of the listener. Alternatively, 'r' may be the distance from the center of the listener's head to both ears. In this case, the distance from the center of the listener's head to the ipsilateral ear and to the contralateral ear may be different each other (for example, r1 and r2). Further, '1 m' indicates the distance from the center of the listener's head to the virtual sound source corresponding to the input audio signal. d_cont indicates the distance from the contralateral ear of the listener to the virtual sound source, and d_ipsil indicates the distance from the ipsilateral ear of the listener to the virtual sound source. The audio signal processing device may determine the contralateral group-delay based on the personalized ITD measured for each specific position with respect to the listener.

Figure 9:
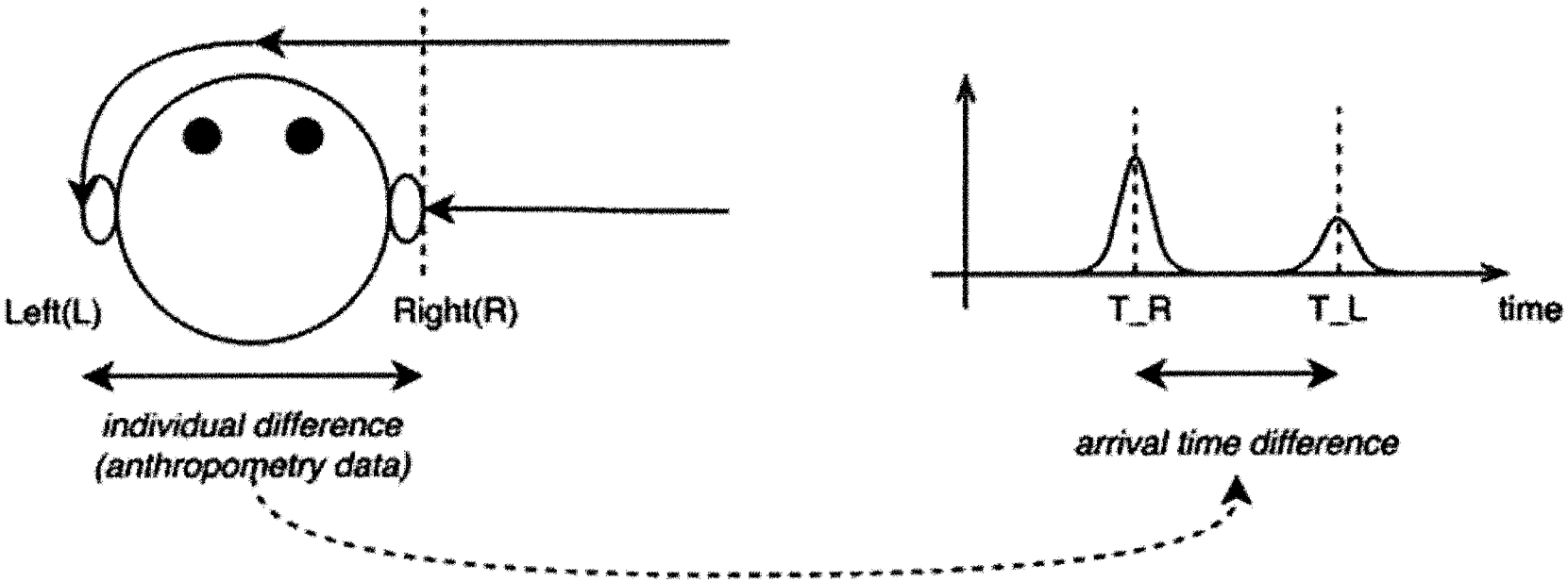
FIG. 9 is a diagram illustrating a method for an audio signal processing device to obtain an ITD by using head modeling information of a listener according to another embodiment of the present disclosure.

FIG. 9 is a diagram illustrating a method for an audio signal processing device to obtain an ITD by using head modeling information of a listener according to another embodiment of the present disclosure. Referring to FIG. 9, a relationship between the time T_L at which sound reaches the left side of the listener corresponding to a contralateral and the phase response of the left HRTF phi_L, and a relationship between the time T_R at which sound reaches the right side of the listener corresponding to an ipsilateral and the phase response of the right HRTF phi_R may be as shown in Equation 6, respectively.

$$phi_L=-w\cdot T_L$$

$$phi_R=-w\cdot T_R \quad \text{[Equation 6]}$$

In Equation 6, 'w' denotes angular frequency. The derivative values of phi_L and phi_R with respect to 'w' are constant as −T_L and −T_R, respectively. Thus, group-delays of each of the left side and the right side may be the same throughout the frequency domain, respectively. The audio signal processing device may obtain T_L and T_R based on the position of the virtual sound source and the head size information. For example, the audio signal processing device may obtain the T_L and T_R by calculating as shown in Equation 7, based on the distance d between the virtual sound source and the right ear, and the radius r of the approximated sphere based on the head of the listener.

$$T_R=d/c \quad \text{[Equation 7]}$$

where, T_L=T_R+(r+pi*r/2)/c, and pi is circumference.

Further, according to an embodiment, the audio signal processing device may calculate the modified ITD' by adding an additional delay in addition to the obtained ITD. For example, the audio signal processing device may calculate the modified ITD' by adding different additional delays (Delay_add) according to the angle between the listener and the sound source. Equation 8 shows a method of adding the additional delay (Delay_add) by dividing a section with respect to the azimuth determined by positions of the listener and the sound source. In Equation 8, 'slope' may indicate the slope of the phase response set based on a user-input, for each azimuth section. Also, round (x) denotes a function for outputting the result of rounding off the x value. And d1 and d2 denote parameters for determining the slope of the phase response for each azimuth section. For example, the audio signal processing device may set the values of d1 and d2 based on the user input, respectively.

$$ITDs' = ITDs + Delay_add$$

$$Delay_add = round(slope * azimuth), \quad \text{[Equation 8]}$$

where if 0<=azimuth <=45, then slope=1/d1 (0<d1 and, d1 is an integer), and if 45<azimuth <=90, then slope=1/d2 (0<d2 and, d2 is an integer).

Also, according to an embodiment, the group-delay may be a delay time corresponding to an integer number of sample(s) based on a sampling frequency. In this case, additional utilization of an audio signal whose characteristics have been modified may be increased. The audio signal processing device may set the ipsilateral group-delay and the contralateral group-delay which is an integer multiple(s) of the sample(s). Further, when a sample out of the frame size occurs, the audio signal processing device may truncate an area that is symmetric to the sample out of the frame size based on the peak point from the front of the HRIR sample. Thus, the audio signal processing device may reduce the deterioration in sound quality caused by the sample out of the frame size.

Meanwhile, in order to perform binaural rendering covering all points on a virtual three-dimensional space around a listener, an audio signal processing device needs to obtain HRTF corresponding to all points. However, since constraints in measurement process and capacity of storable data are limited, additional processing may be required to obtain the HRTF corresponding to all points in the virtual three-dimensional space. In addition, in the case of measurement-based HRTF, additional processing may be required due to an error in magnitude response and phase response occurred during the measurement process.

Accordingly, an audio signal processing device, by using a plurality of HRTFs obtained previously, may generate an HRTF corresponding to a position other than the position of each of the plurality of obtained HRTFs. Thus, the audio signal processing device may enhance a spatial resolution of the audio signal simulated in the virtual three-dimensional space, and correct errors in the magnitude response and the phase response. Hereinafter, the method for obtaining the HRTF corresponding to the position other than the positions corresponding to the plurality of HRTFs included in the set of HRTFs by the audio signal processing device according to an embodiment of the present disclosure will be described with reference to FIGS. 10 to 14 for.

Figure 10:
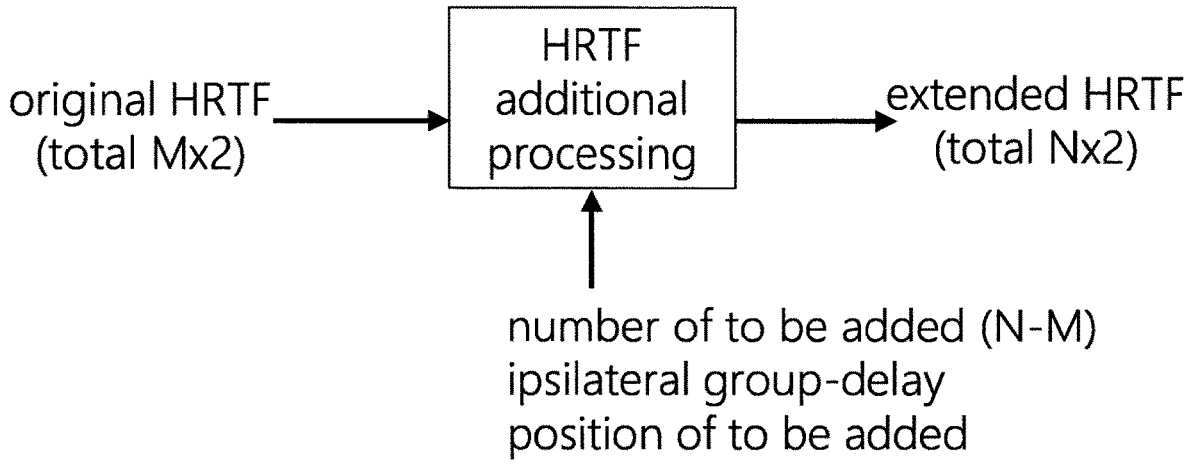
FIG. 10 is a diagram illustrating a method for an audio signal to enhance spatial resolution according an embodiment of the present disclosure.

FIG. 10 is a diagram illustrating a method for an audio signal to enhance spatial resolution according an embodiment of the present disclosure. According to an embodiment, the audio signal processing device may obtain an original set of HRTFs containing an original HRTF pair corresponding to each of the M positions. The audio signal processing device may obtain an extended set of HRTFs including an HRTF pair corresponding to each of the N positions based on the original set of HRTFs. In this case, N may be an integer larger than M. In addition, the extended HRTF set may include (N-M) additional HRTF pairs in addition to the original set of HRTFs. In this case, the audio signal processing device may configure the extended set of HRTFs by modifying a phase response of each of the M of HRTF pairs included in the original set of HRTFs. In this case, the audio signal processing device may modify the phase response of each of the HRTFs included in the original set of HRTFs by the method described in FIGS. 2 to 9 described above.

In addition, the audio signal processing device may receive an input to at least one of the number (N-M) of HRTFs to be added, the position of the HRTF to be added, or the group-delay, in processing the original HRTF pair. Specifically, the original set of HRTFs may include HRTFs for each angle according to predetermined angular spacing. Where the angle may be at least one of an azimuth or an elevation on a unit sphere centered at the listener. In addition, the predetermined angular spacing may include an angular spacing in the elevation direction and an angular spacing in the azimuth direction. In this case, the angular spacings for the elevation direction and the azimuth angle direction may be set to be different from each other.

For example, the audio signal processing device may obtain an HRTF corresponding to a position between a first angle and a second angle according to the predetermined angular interval. Specifically, the first angle and the second angle may have the same azimuth value and different elevation values separated by a predetermined angle interval. In this case, the audio signal processing device may interpolate a first HRTF corresponding to the first angle and a second HRTF corresponding to the second angle to generate a third HRTF corresponding to the different angle of elevation between the first angle and the second angle. In the above-described method, the audio signal processing device may generate a plurality of HRTFs corresponding to each of a plurality of positions located between the first angle and the second angle. Here, the number of HRTFs to be subjected to interpolation is described as two, but this is merely an example, and the present disclosure is not limited thereto. A plurality of HRTFs adjacent to a specific position may be interpolated to obtain HRTF corresponding to the specific position.

In this case, as described above, when the audio signal processing device interpolates a plurality of HRTFs in a frequency domain, the amount of computation for Fourier transform and inverse Fourier transform processed in the audio signal processing device may increase. Accordingly, an audio signal processing device according to an embodiment of the present disclosure may modify the phase response of each of a plurality of original HRTFs included in an original set of HRTFs. In addition, the audio signal processing device may generate an extended set of HRIR by interpolating, in the time domain, a plurality of HRTFs whose phase response is modified. Thus, the audio signal processing device may reduce the amount of unnecessary calculation. Hereinafter, a method for increasing the spatial resolution of an audio signal by the audio signal processing device will be described in detail with reference to FIG. 11.

Figure 11:
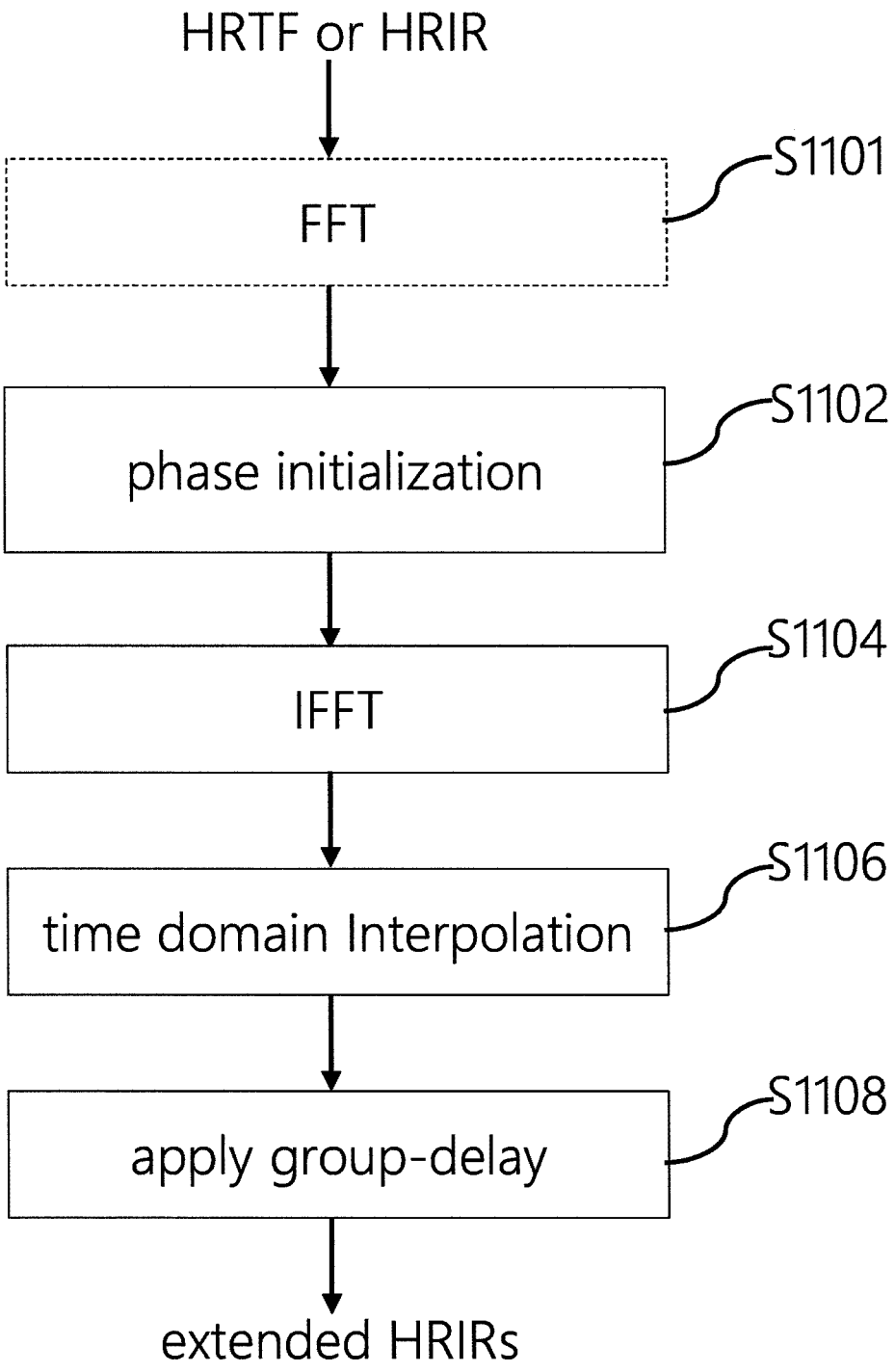
FIG. 11 is a diagram illustrating a method for an audio signal processing device according to an embodiment of the present disclosure to generate an extended set of HRIRs from an original set of HRIRs.

FIG. 11 is a diagram illustrating a method for an audio signal processing device according to an embodiment of the present disclosure to generate an extended set of HRIRs from an original set of HRIRs. In step S1102, the audio signal processing device may initialize a phase response of each of the plurality of original HRTFs included in the original set of HRTFs. The audio signal processing device may modify the phase response of each of the plurality of original HRTFs to have the same phase response with each other. The audio signal processing device may match the phase responses of each of the original HRTFs corresponding to the positions of the sound sources with respect to the listener so as to have the same phase response regardless of the positions of the sound sources. In this case, in the time domain, a plurality of HRIRs has a peak value at the same sample time. Accordingly, the audio signal processing device may generate a binaural filter having a peak value at the same sample time when the audio signal processing device linearly combine HRTFs corresponding to positions of a plurality of different sound sources in the time domain. In addition, the audio signal processing device may generate a binaural filter having a peak value at the same sample time even if the audio signal processing device linearly combine HRTF having the same phase characteristics in the frequency domain with another transfer function.

For example, the same phase response may be a zero-phase response. In the case of zero-phase response, the computational process required to binaural render based on HRTF may be facilitated. If the HRTF is a zero-phase response, the HRIR in the time domain may have a peak value at time '0'. Thus, an audio signal processing device according to an embodiment of the present disclosure may perform interpolation for a plurality of HRIRs in the time domain to reduce the amount of computation for generating an output audio signal. At the same time, the audio signal processing device may reduce the timbre distortion due to the comb-filtering described above.

According to an embodiment, the audio signal processing device may obtain a set of HRTFs in the form of HRIR, which is a response in the time domain. In this case, in step S1101, the audio signal processing device may convert the original HRIR included in the obtained set of HRTFs to a response in the frequency domain. For example, an audio signal processing device may perform FFT on an original HRIR to obtain an original HRTF in the frequency domain. Further, the audio signal processing device may perform the above-described phase response initialization on the original HRTF transformed into the response in the frequency domain to obtain the HRTF of which the phase response is initialized.

In step S1104, the audio signal processing device may convert the HRTFs whose phase responses have been initialized to a response in the time domain, to obtain the HRIRs whose phase responses is initialized. The audio signal processing device may perform the IFFT on the HRTFs whose phase response is initialized to obtain the HRIRs whose phase response is initialized. In step S1106, the audio signal processing device may generate HRIR's corresponding to positions other than the positions corresponding to the original HRTFs by interpolating at least two HRIRs of which phase responses of each HRIR is initialized, in the time domain. This is because the temporal positions of the peak values of the plurality of HRIRs corresponding to each of the plurality of HRTFs whose phase response is initialized coincide with each other, as described above. In this case, the audio signal processing device may generate the number (N-M) of HRIR's to be added based on the position of the HRTF to be added. Hereinafter, the set of HRIRs including the HRIRs whose phase response is initialized and the additionally generated HRIR's are referred to as a first set of HRIRs.

In step S1108, the audio signal processing device may apply the group-delay to each of the plurality of a first HRIRs included in the first set of HRIRs to generate an extended set of HRIRs. If the peak value of a HRIR is located at the time '0' (i.e., a phase response of a HRTF is a zero-phase response), the audio signal processing device may apply the set group-delay to each of the plurality of the first HRIRs, obtained in the step S1106, without additional editing. The audio signal processing device may obtain the group-delay applied to each of the plurality of the first HRIRs based on the method for obtaining the group-delay for each ipsilateral and contralateral, described with reference to FIGS.

For example, the audio signal processing may time delay each of the plurality of ipsilateral HRIRs included in the first set of HRIRs based on an ipsilateral group-delay which is the same value regardless of a position of a sound source. In this case, the ipsilateral group-delay may be a value set based on the frame size. Further, the audio signal processing device may determine a contralateral group-delay applied to a plurality of contralateral HRIRs included in the first set of HRIRs based on the ITD described above. In this case, the contralateral group-delay may be the ITD time according to the position of the virtual sound source corresponding to the input audio signal with respect to the listener added to the ipsilateral group-delay. Accordingly, the audio signal processing device may generate the extended set of HRTFs that includes a greater number of HRTFs than the original set of HRTFs based on the original set of HRTFs. Further, the audio signal processing device may increase a spatial resolution of the audio signal in the virtual three-dimensional space around the listener efficiently in terms of the amount of computation and the timbre distortion. The audio signal processing device may increase the spatial resolution of the audio signal to enhance a sound image localization performance.

Meanwhile, in FIG. 11, the phase response initialization process may be omitted. For example, the audio signal processing device may obtain an HRTF set in which the phase response of each of a plurality of HRTFs is initialized. The audio signal processing device may obtain a set of HRTFs including a plurality of HRTFs corresponding to each of positions of a sound source with respect to the listener, of which the phase responses are same each other. The audio signal processing device may obtain the set of HRTFs in which the phase responses are initialized from the database storing the set of HRTFs, described through FIG. 1. Further, the audio signal processing device may use a set of HRTFs that is stored in the audio signal processing device and the phase response is initialized.

Figure 12:
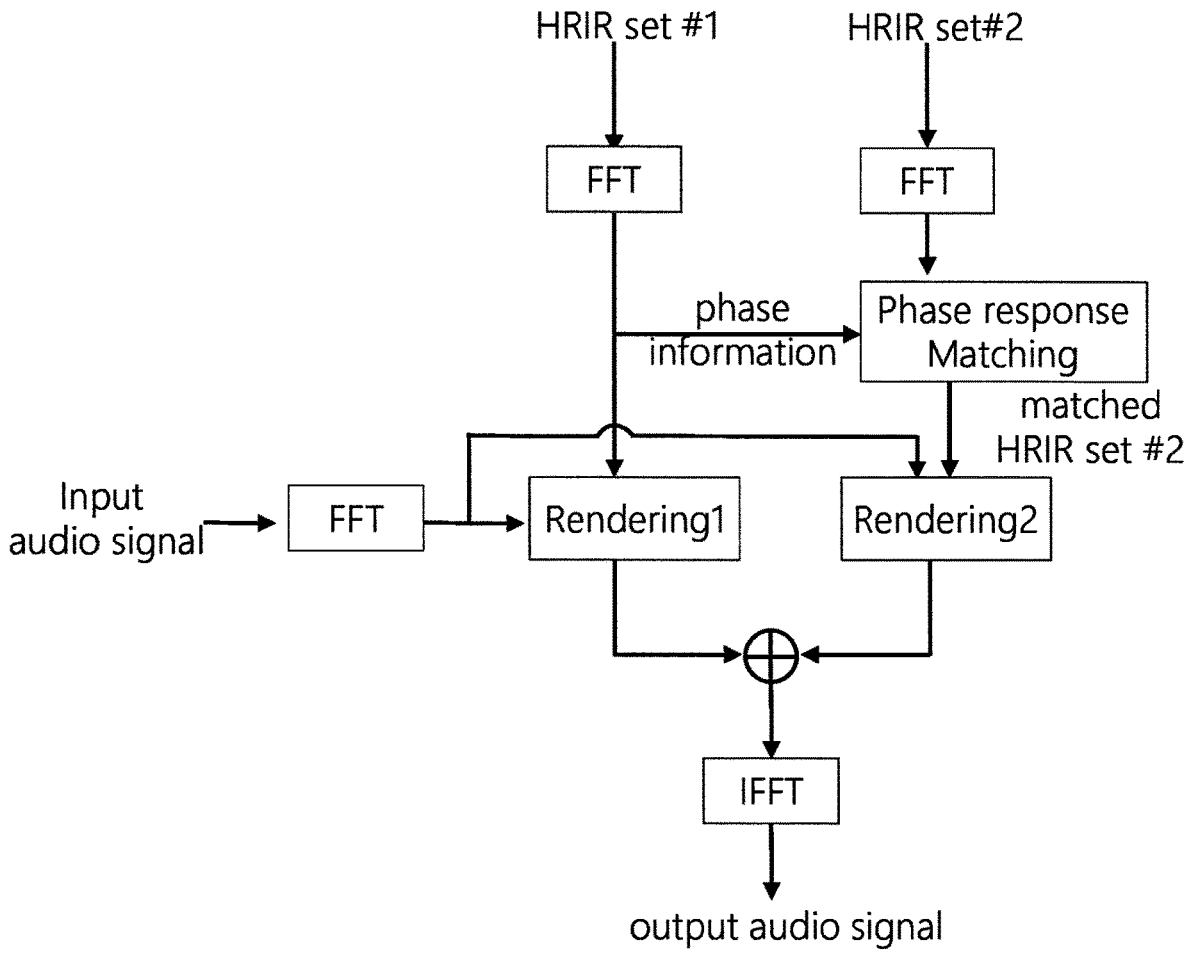
FIG. 12 is a diagram illustrating a method for an audio signal processing device according to an embodiment of the present disclosure to linearly combine output audio signals binaural rendered based on a plurality of HRTF sets to generate a final output audio signal.

Hereinafter, a method for an audio signal processing device according to an embodiment of the present disclosure to generate a final output audio signal based on a plurality of HRTF sets will be described. In this way, the audio signal processing device may correct errors in size response and phase response of the HRTF obtained by measurement. FIG. 12 is a diagram illustrating a method for an audio signal processing device according to an embodiment of the present disclosure to linearly combine output audio signals binaural rendered based on a plurality of HRTF sets to generate a final output audio signal.

According to an embodiment, the audio signal processing device may obtain a second set of HRTFs different from a first set of HRTFs. In this case, the first set of HRTFs may include a plurality of HRTFs that phase responses of the plurality of HRTFs are modified as the process of FIG. 11. Further, the first set of HRTFs and the second set of HRTFs may be HRTF sets obtained in different manners. For example, the first set of HRTFs and the second set of HRTFs may be HRIR sets measured by using different types of head models. As in FIG. 12, when the audio signal processing device obtains a first set of HRIRs and a second set of HRIRs, the audio signal processing device performs an FFT for each of the plurality of HRIRs included in the first set of HRIRs and the second set of HRIRs to obtain the first set of HRTFs and the second set of HRTFs.

Next, the audio signal processing device may set the phase response of each of a plurality of second HRTF pairs included in the second set of HRTFs to the phase response of each of a plurality of first HRTF pairs included in the first set HRTFs based on a phase information. For example, the audio signal processing device may match the phase response of each of the second HRTF pairs with the phase response of the first HRTF pairs for each position. The audio signal processing device may match the plurality of first HRTF pairs and the plurality of second HRTF pairs based on a position corresponding to each of the first and second HRTF pairs. For example, a first HRTF pair corresponding to a first position among the plurality of first HRTF pairs, and a second HRTF pair corresponding to the first position among the plurality of second HRTF pairs may be matched with each other. The audio signal processing device may set the phase response of each of the plurality of second HRTF pairs to the phase response of each of the plurality of the matched first HRTF pairs based on the phase information. Here, the phase information may be phase responses information of each of the first HRTF pairs for each position, stored in the audio signal processing device or an external device. The phase information may be stored as a look-up table form.

The first HRTF pair may include a first ipsilateral HRTF and a first ipsilateral HRTF. The second HRTF pair may also include a second ipsilateral HRTF and a second ipsilateral HRTF. Further, the first HRTF pair and the second HRTF pair may be HRTF pairs corresponding to the first position, respectively. For example, the audio signal processing device may match the phase responses of the first ipsilateral HRTF and the second ipsilateral HRTF. Further, the audio signal processing device may match the phase responses of the first contralateral HRTF and the second contralateral HRTF. The audio signal processing device may set the phase response of each of the second HRTF pair to the phase response of each of the first HRTF pair to generate a second HRTF' pair having a matched phase response.

Next, the audio signal processing device may binaural render the input audio signal based on any one of the plurality of first HRTF pairs to generate a first output audio signal (Render 1 in FIG. 12). In addition, the audio signal processing device may binaural render the input audio signal based on any one of the plurality of second HRTF' pairs to generate a second output audio signal (Render 2 of FIG. 12). In this case, if the input audio signal is a sample in the time domain, the audio signal processing device may perform an FFT process for converting the input audio signal into a frequency domain signal, additionally. Next, the audio signal processing device may synthesize the first output audio signal and the second output audio signal to generate a final output audio signal. In addition, the audio signal processing device may perform IFFT on the final output audio signal in the frequency domain to convert it into the final output audio signal in the time domain.

Figure 13:
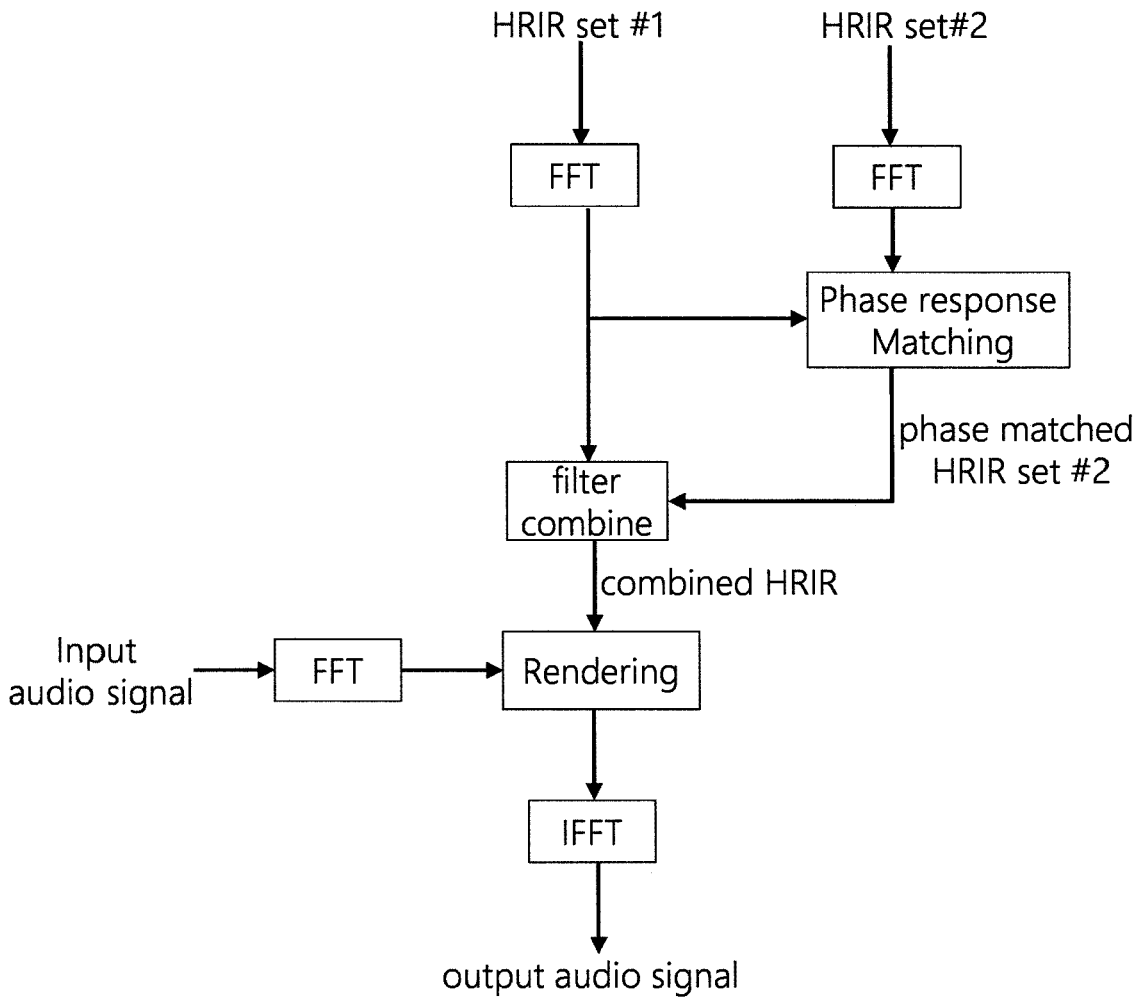
FIG. 13 is a diagram illustrating a method for an audio signal processing device to generate an output audio signal based on HRTF generated by linearly combining a plurality of HRTFs according to an embodiment of the present disclosure.

Meanwhile, in addition to a method of synthesizing audio signals generated through individual rendering, a plurality of HRTFs may be linearly combined to generate a combined HRTF. In this case, the amount of calculation required for rendering may be reduced as compared with a method of synthesizing audio signals. FIG. 13 is a diagram illustrating a method for an audio signal processing device to generate an output audio signal based on HRTF generated by linearly combining a plurality of HRTFs according to an embodiment of the present disclosure.

According to an embodiment, the audio signal processing device may linearly combine the first HRTF pair and the second HRTF' pair which phase responses are matched as described above, to generate a combined HRTF. Here, the linear combination may mean either a median or a mean. For example, the audio signal processing device may obtain a combined ipsilateral (contralateral) HRTF by calculating based on the magnitude responses of the first ipsilateral (contralateral) HRTF and the second ipsilateral (contralateral) HRTF', for each frequency bin. Since phase responses of the first HRTF pair and the second HRTF' pair are matched, a separate linear combination operation is not required. Next, the audio signal processing device may binaural render the input audio signal based on the combined HRTF to generate the final output audio signal in the frequency domain. In addition, the audio signal processing device may perform IFFT on the final output audio signal in the frequency domain to generate the final output audio signal in the time domain.

Figure 14:
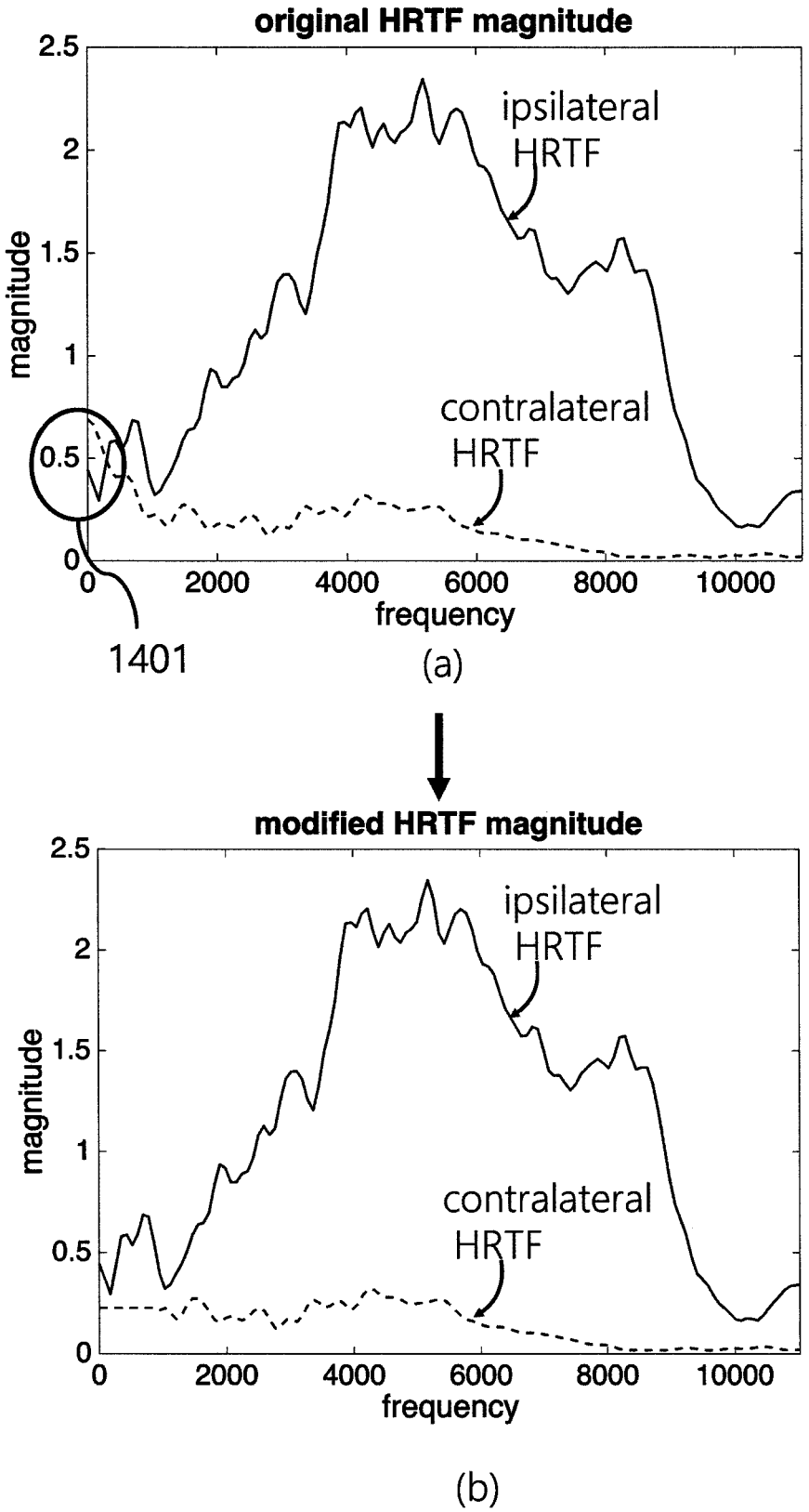
FIG. 14 is a diagram illustrating a method for an audio signal processing device according to another embodiment of the present disclosure to correct a measurement error in an HRTF pair.

FIG. 14 is a diagram illustrating a method for an audio signal processing device according to another embodiment of the present disclosure to correct a measurement error in an HRTF pair. Referring to (a) in FIG. 14, an inverse section 1401 in which a magnitude of a frequency response of a contralateral HRTF may be larger than a magnitude of a frequency response of an ipsilateral HRTF may occur. Since a contralateral of a listener from a virtual sound source corresponding to an input audio signal may be relatively far from an ipsilateral of the listener, the inverse section 1401 may correspond to a measurement error. Accordingly, the audio signal processing device according to an embodiment of the present disclosure may modify magnitude value(s) of the contralateral HRTF corresponding to the frequency bin included in the inverse section 1401 to a predetermined value. For example, the predetermined value may be a magnitude value corresponding to a frequency bin at which an inversion of magnitude response begins to cease. Referring to (b) in FIG. 14, the audio signal processing device may modify magnitude value(s) of the ipsilateral HRTF corresponding to the frequency bin included in the inverse section 1401 to a value that is greater than or equal to the magnitude value of the contralateral HRTF. Thereby, the audio signal processing device may prevent the sound corresponding to some frequencies from being heard louder on the contralateral of the listener than on the ipsilateral of the listener, thereby providing a more accurate sense of directionality to the listener.

Meanwhile, the audio signal processing device may synthesize a binaural-rendered audio signal with an additional signal to enhance the expressiveness of the binaural-rendered audio signal. In addition, the audio signal processing device may binaural render an audio signal based on a filter obtained by combining HRTF with an additional filter for enhancing the expressiveness of an output audio signal. In the present disclosure, the additional signal may be an audio signal generated based on the additional filter. For example, the audio signal processing device may use one or more filters in addition to the HRTF according to the position of the virtual sound source corresponding to the object audio signal to generate an output audio signal. In this case, if a phase response of the additional filter and the HRTF do not match, the sound quality may be deteriorated due to the comb-filtering effect.

Figure 15:
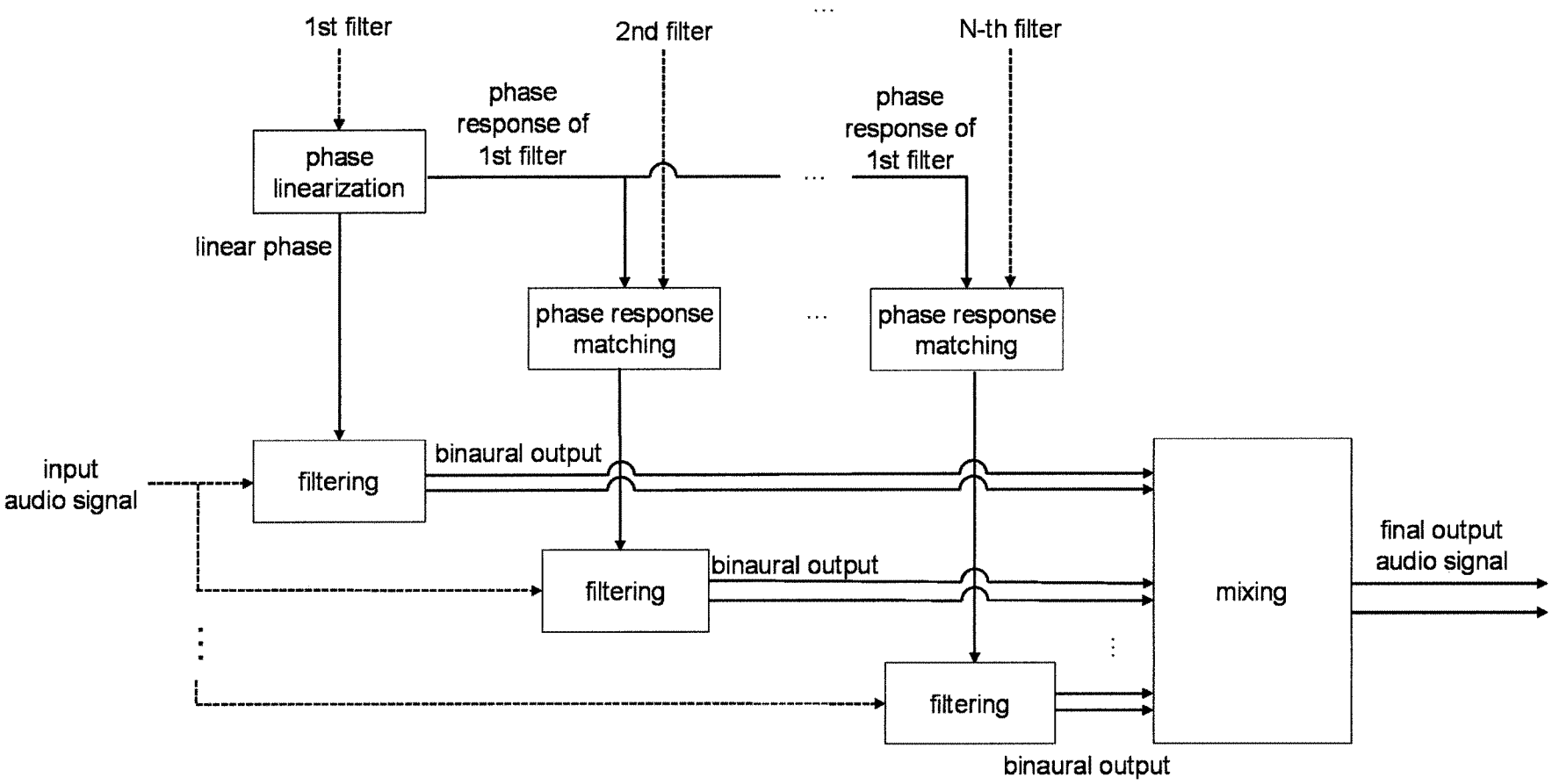
FIG. 15 is a block diagram illustrating operations of an audio signal processing device according to an embodiment of the present disclosure to generate an output audio signal based on a plurality of filters in a time domain.

FIG. 15 is a block diagram illustrating operations of an audio signal processing device according to an embodiment of the present disclosure to generate an output audio signal based on a plurality of filters in a time domain. Hereinafter, in the embodiment related to FIGS. 15 to 28, a first filter may refer to a HRTF or HRIR as described above. Further, a second to N-th filters may refer to additional filters. According to an embodiment, the audio signal processing device may obtain an additional filter configured with a pair of gains and a pair of phase responses, including an ipsilateral and a contralateral for an input audio signal. Further, the audio signal processing device may generate an output audio signal by using a plurality of additional filters.

In this case, the audio signal processing device may obtain the first filter whose phase response has been modified in the method described above with reference to FIGS. 3 to 9. For example, the audio signal processing device may linearize the phase response of each of the obtained ipsilateral and contralateral HRTFs to generate a first ipsilateral filter and a first contralateral filter. Further, the audio signal processing device may match the phase response of each of the plurality of additional filters with the phase response of the first filter. Accordingly, the audio signal processing device may mix the audio signals filtered based on the plurality of filters in the time domain without distortion of the timbre. Referring to FIG. 15, an audio signal processing device may generate a plurality of binaural output audio signals by using first through Nth filters. Next, the audio signal processing device may mix a plurality of binaural output audio signals to generate a final output audio signal. In this case, the audio signal processing device may mix the plurality of binaural output audio signals based on a mixing gain indicating a ratio at which each of the plurality of binaural output audio signals is mixed. Meanwhile, the mixing gain may be used in a ratio in which a plurality of filters is reflected in the combined filter, in a filter combining process to be described later.

Further, each of the plurality of additional filters may be a filter for different effects. For example, the plurality of additional filters may comprise a plurality of HRTFs (HRIRs) obtained in different ways as described above with reference to FIGS. 12 and 13. The plurality of additional filters may include filters other than HRTF. For example, the plurality of additional filters may include a panning filter that adjusts the binaural effect strength (BES). The plurality of additional filters may include a filter that simulates a size of a virtual sound source corresponding to an input audio signal and distance from a listener to the virtual sound source. Hereinafter, a method of generating an output audio signal by using an HRTF and a panning filter by the audio signal processing device will be described with reference to FIGS. 16 to 21.

Figure 16:
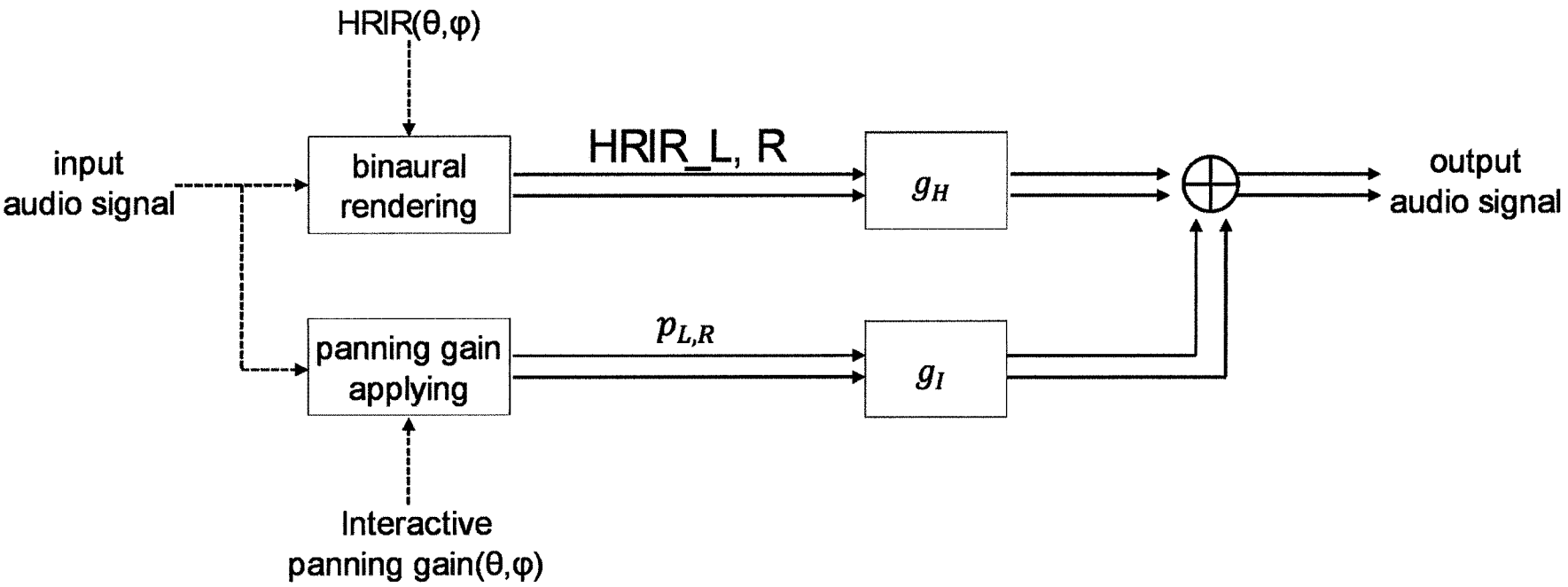
FIG. 16 is a diagram illustrating a method for an audio signal processing device according to an embodiment of the present disclosure to adjust a binaural effect strength by using panning gain.

FIG. 16 is a diagram illustrating a method for an audio signal processing device according to an embodiment of the present disclosure to adjust a binaural effect strength by using panning gain. According to an embodiment, the audio signal processing device may use additional filters to adjust the binaural effect strength of the audio signal binaural rendered based on the HRTF. In this case, the additional filter may be flat responses corresponding to each of the ipsilateral and the contralateral. Here, the flat responses may be a filter response having a constant magnitude in the frequency domain. For example, the audio signal processing device may obtain the flat responses corresponding to each of the ipsilateral and the contralateral by using a panning gain.

In FIG. 16, the audio signal processing device may binaural render an input audio signal based on a first filter (HRIR) to generate a first output audio signal HRIR_L, HRIR_R. Further, the audio signal processing device may binaural render the input audio signal based on the panning gain (interactive panning gain (θ, φ)) to generate a second output audio signal p_L, p_r. Next, the audio signal processing device may mix the first output audio signal and the second output audio signal to generate a final output audio signal. The audio signal processing device may mix the first output audio signal and the second output audio signal based on the mixing gains g_H, g_I indicating the ratio at which each audio signal is mixed. The method by which the audio signal processing device generates the final output audio signals output_L, R may be expressed as Equation 9.

$$\text{output_}L,R=g_H\cdot s(n)*h_L,R(n)+g_I\cdot s(n)\cdot p_L,R, \qquad \text{[Equation 9]}$$

Figure 17:
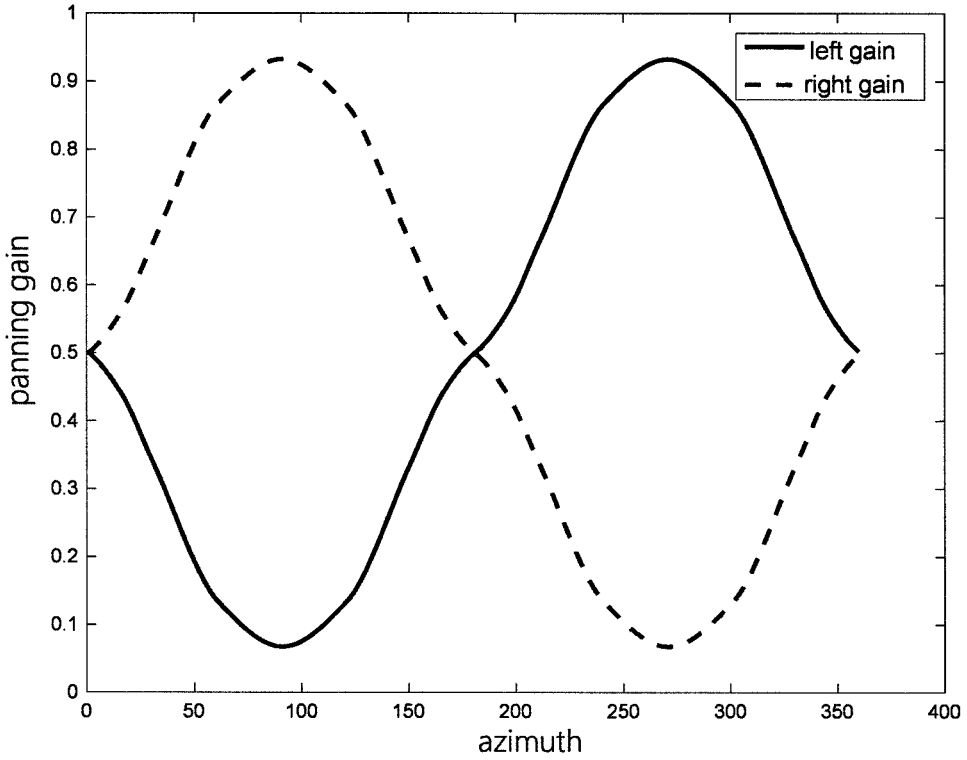
FIG. 17 is a diagram showing the panning gains of the left and right sides, respectively, according to the azimuth with respect to the listener.

In Equation 9, g_H may be a mixing gain of the first output audio signals HRIR_L and HRIR_R. Also, g_I may be a mixing gain of the second output audio signal p_L, p_r. p_L,R denote the left or right channel panning gain, and h_L,R denote the left or right HRIR. n is an integer greater than 0 and less than the total number of samples, and s (n) represents the input audio signal at the nth sample. In addition, * denotes a convolution. In this case, the audio signal processing device may filter the input audio signal by a fast convolution method through a Fourier transform and an inverse Fourier transform. FIG. 17 is a diagram showing the panning gains of the left and right sides, respectively, according to the azimuth with respect to the listener.

According to an embodiment, the audio signal processing device may generate an energy compensated flat response for the ipsilateral and the contralateral gain. The energy level of the output audio signal may be excessively deformed with respect to the energy level of the input audio signal in accordance with the energy level change of the flat response. For example, the audio signal processing device may generate a panning gain based on a magnitude response of the ipsilateral and contralateral HRTFs corresponding to the virtual sound source of the input audio signal. The audio signal processing device may calculate the panning gains p_L and p_R corresponding to the left and right sides, respectively, as shown in Equation 10. For example, the audio signal processing device may determine the panning gains g1 and g2 by using a linear panning method or a constant power panning method. In Equation 10, the audio signal processing device may set the sum of the panning gains corresponding to each of the ears to be 1, to maintain an auditory energy of the input audio signal. In Equation 10, H_meanL represents the mean of the magnitude responses of the left HRTFs for each frequency bin, and H_meanR represents the mean of the magnitude responses of the right HRTFs for each frequency bin. In this case, a represents an azimuth index in IPC (Interaural Polar Coordinate), and k represents an index of a frequency bin.

$$p_L+p_R=1,$$

$$p_L=H_\text{mean}L(a)/(H_\text{mean}L(a)+H_\text{mean}R(a)),$$

$$p_R=H_\text{mean}R(a)/(H_\text{mean}L(a)+H_\text{mean}R(a)), \qquad \text{[Equation 10]}$$

where H_meanL(a)=mean(abs(H_L(k))), and H_meanR (a)=mean(abs(H_R(k))).

Figure 18:
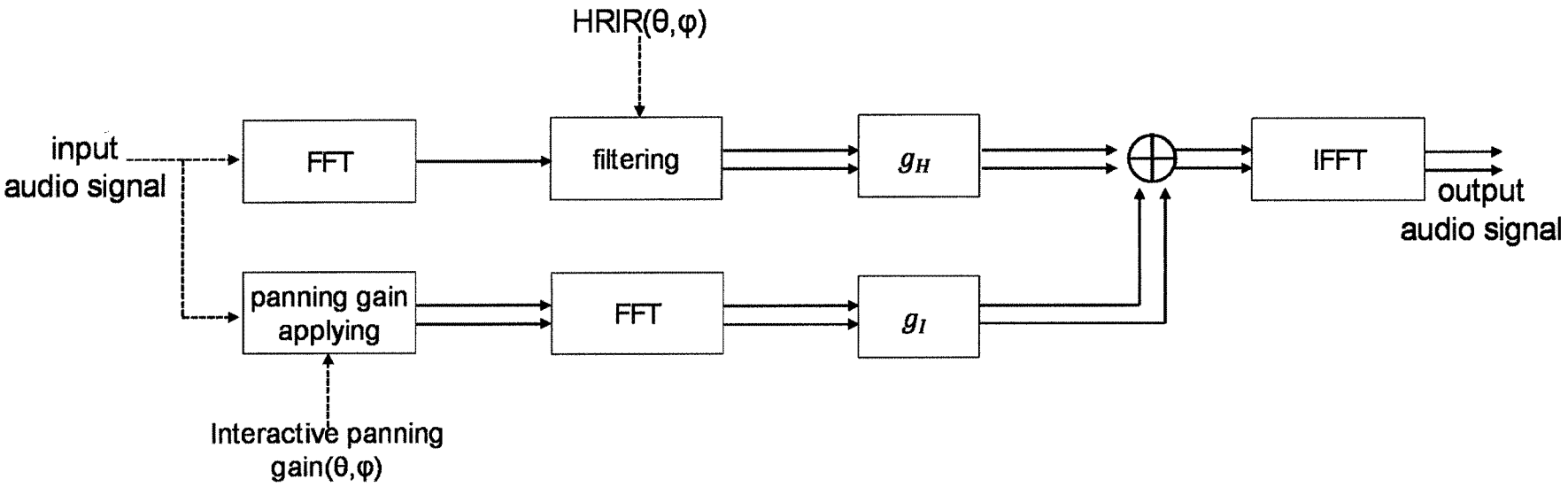
FIG. 18 is a block diagram illustrating operations of an audio signal processing device according to an embodiment of the present disclosure to generate an output audio signal based on a first filter and a second filter in a frequency domain.

FIG. 18 is a block diagram illustrating operations of an audio signal processing device according to an embodiment of the present disclosure to generate an output audio signal based on a first filter and a second filter in a frequency domain. The audio signal processing device may convert the input audio signal into a frequency domain signal. The audio signal processing device may filter the converted signal based on the above-described first filter to generate a first output audio signal. Further, the audio signal processing device may convert the input audio signal to which the above-described panning gain is applied, into a frequency domain signal to generate a second output audio signal. Next, the audio signal processing device may mix the first output audio signal and the second output audio signal on the basis of g_H and g_I to generate a final output audio signal in the frequency domain. The audio signal processing device may convert the mixed final output audio signal into a time domain signal. In FIG. 18, a method by which the audio signal processing device generates the final output audio signal OUT_hat may be expressed as shown in Equation 11.

$$\text{OUT_hat}=\text{IFFT}[g_H\cdot\text{mag}\{S(k)\}\cdot\text{mag}\{H_L,R(k)\}\cdot \text{pha}\{S(k)+H_L,R(k)\}+g_I\cdot\text{mag}\{S(k)\}\cdot\text{mag}\{P_L,R(k)\}\cdot\text{pha}\{S(k)+P_L,R(k)\} \quad \text{[Equation 11]}$$

In Equation 11, H_L,R (k), P_L, R (k), and S (k) denote frequency responses of h_L, R (n), p_L, R (n), and s(n) in a time domain, respectively. In addition, k represents the index of the frequency bin, and mag {x} and pha {x} represent the magnitude component and the phase component of the frequency response 'x', respectively.

Figure 19:
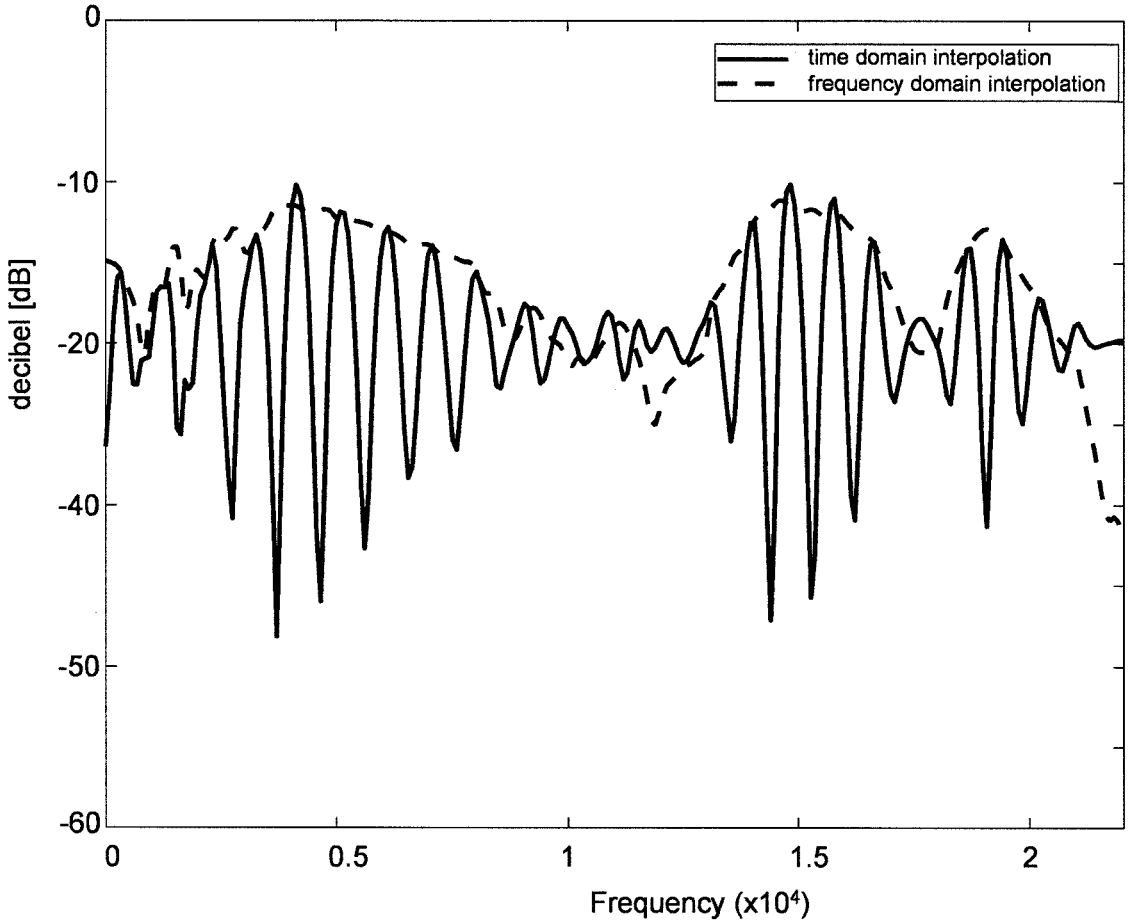
FIG. 19 is a graph showing an output audio signal obtained through FIG. 17 and FIG. 18 in a time domain.

FIG. 19 is a graph showing time-domain output audio signals obtained through FIGS. 17 and 18. Referring to the solid line in FIG. 19, when the audio signal processing device mixes the first output audio signal and the second output audio signal in the time domain, a comb-filtering effect occurs. On the other hand, referring to the broken line in FIG. 19, when the audio signal processing device mixes the first output audio signal and the second output audio signal in the frequency domain, the comb-filtering effect does not occur. This is because the audio signal processing device may separately interpolate the magnitude component and the phase component of a plurality of audio signals in the frequency domain. However, as shown in FIG. 18, when the audio signal processing device separates the process of the magnitude component and the phase component of the audio signal in the frequency domain, the amount of computation may be increased. Due to this increase in computation, it may be difficult to linearly combine the audio signal in a device such as a mobile device that has a limitation on the amount of computation. Accordingly, the audio signal processing device according to an embodiment of the present disclosure may match the phase response of each of the plurality of filters on the ipsilateral and on the contralateral (or the left side and the right side). Thus, the audio signal processing device may reduce the amount of computation required for interpolation.

Figure 20:
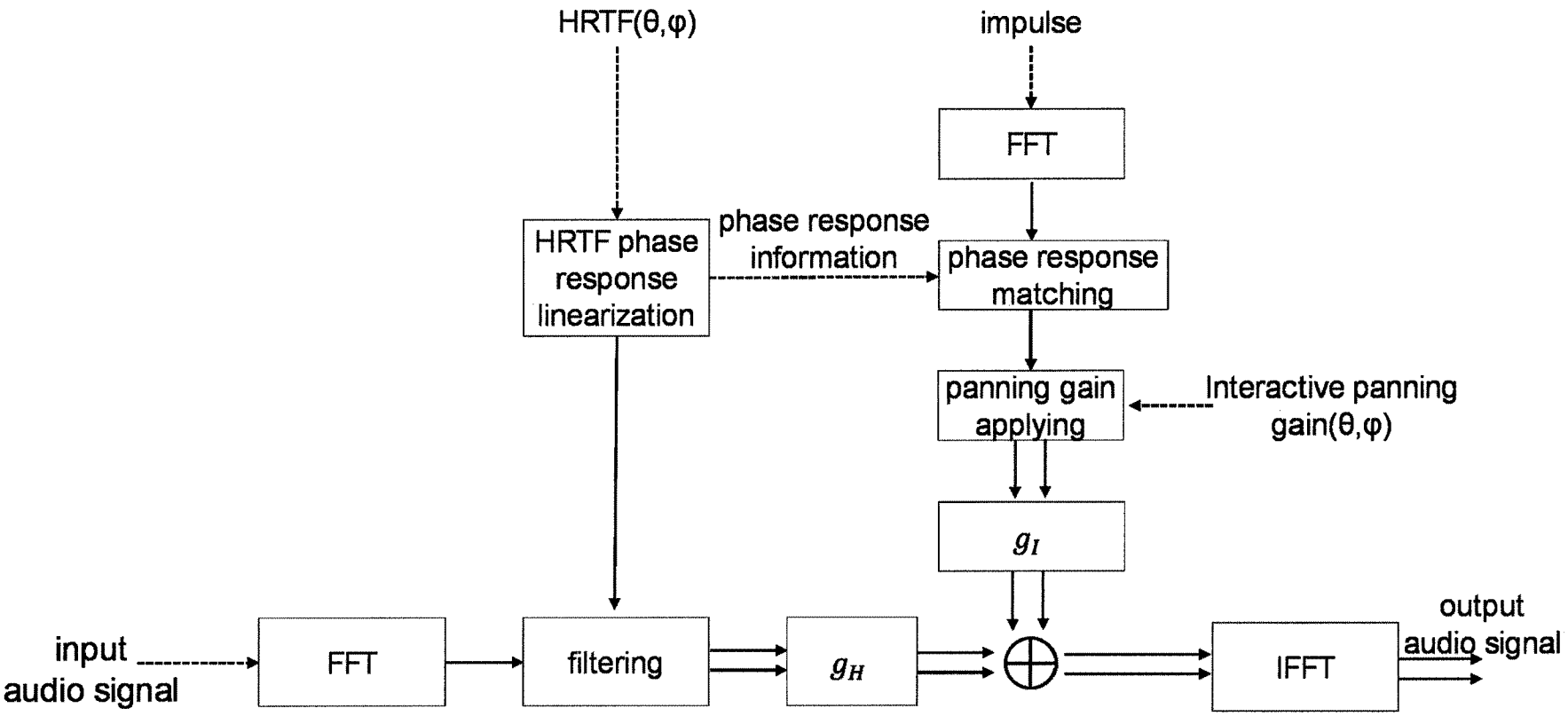
FIG. 20 is a block diagram showing a method of generating an output audio signal based on a phase response matched on an ipsilateral and on a contralateral by the audio signal processing device according to the embodiment of the present disclosure.

FIG. 20 is a block diagram showing a method of generating an output audio signal based on a phase response matched on an ipsilateral and on a contralateral by the audio signal processing device according to the embodiment of the present disclosure. According to an embodiment, the audio signal processing device may obtain an HRTF pair based on a position of a virtual sound source corresponding to the input audio signal. Further, the audio signal processing device may modify the phase response of each of an ipsilateral HRTF and a contralateral HRTF included in the HRTF pair by the method described above with reference to FIGS. 3 to 9. In this case, the audio signal processing device may modify the phase response of the ipsilateral HRTF to the same common phase response regardless of positions of sound sources for each of the plurality of ipsilateral HRTFs included in a set of HRTFs. In addition, the phase response of each of the modified ipsilateral and contralateral HRTFs may be a linear phase response. Next, the audio signal processing device may match the phase response of the ipsilateral and contralateral panning filters generated based on the panning gain with the phase response of each of the ipsilateral and contralateral HRTFs. The audio signal processing device may mix the first output audio signal to which the HRTF is applied and the second output audio signal to which the panning filter is applied based on the mixing gain g_H and g_I. The final output audio signal OUT_hat_lin generated based on the matched phase H_Lin (k) may be expressed by Equation 12.

$$\text{OUT_hat_lin}=\text{IFFT}[g_H\cdot\text{mag}\{H_\text{lin}(k)\}\cdot\text{mag}\{S(k)\}\cdot \text{pha}\{H_\text{lin}(k)+S(k)\}+g_\cdot\text{mag}\{P_L,R(k)\}\cdot\text{mag}\{S(k)\}\cdot\text{pha}\{H_\text{lin}(k)+S(k)\}] \quad \text{[Equation 12]}$$

Figure 21:
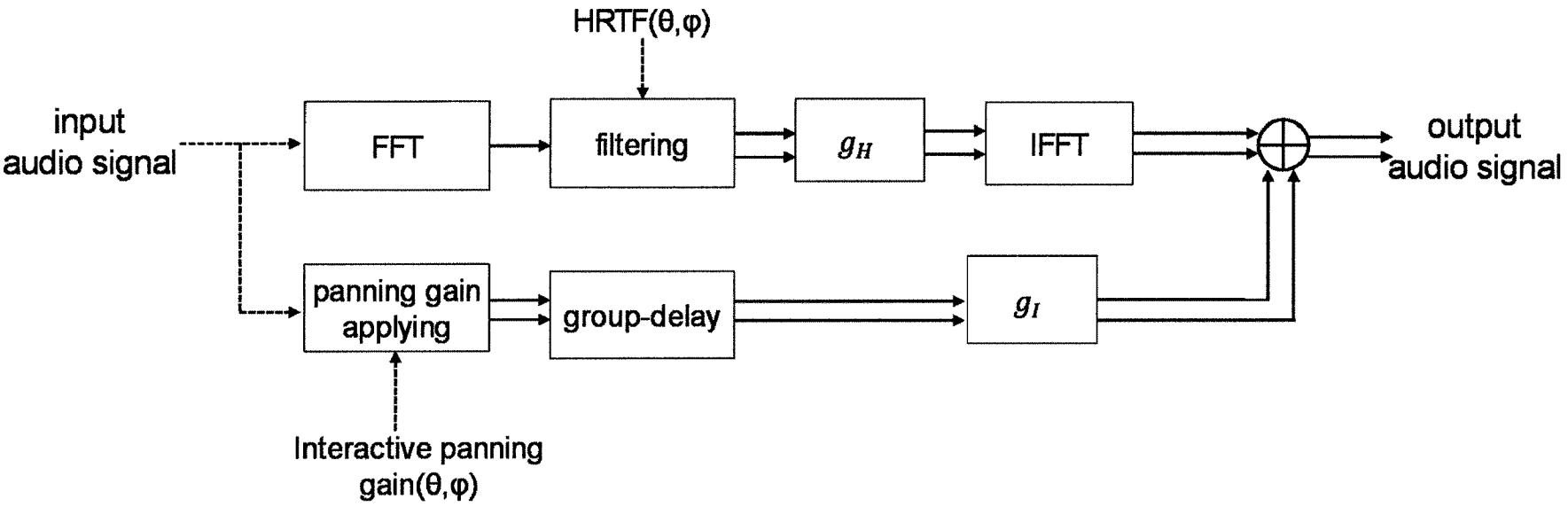
FIG. 21 is a block diagram illustrating a method for an audio signal processing device according to an embodiment of the present disclosure to generate an output audio signal based on HRTF and additional filter(s).

In addition, the audio signal processing device may omit at least a portion of the Fourier transform operations to reduce the amount of computation required for generating a final output audio signal. FIG. 21 is a block diagram illustrating a method for an audio signal processing device according to an embodiment of the present disclosure to generate an output audio signal based on HRTF and additional filter(s). According to an embodiment, the audio signal processing device may apply panning gain to the magnitude response of the input audio signal in the time domain. Further, the audio signal processing device may generate a second output audio signal by time delaying the input audio signal to which the panning gain is applied, based on the group-delay. In this case, each of the ipsilateral and the contralateral group-delay may be a group-delay corresponding to the phase response of each of the ipsilateral and the contralateral HRTF. Further, the phase response of each of the ipsilateral HRTF and the contralateral HRTF may be a linear phase response. The audio signal processing device may generate the final output audio signal OUT_hat_lin as in Equation 12 through the operation as in Equation 13. In Equation 13, t_cont, ipsil represents a personalized opposite side or ipsilateral group-delay.

$$\text{OUT_hat_lin}=\text{IFFT}[g_H\cdot\text{mag}\{H_\text{lin}(k)\}\cdot\text{mag}\{S(k)\}\cdot \text{pha}\{H_\text{lin}(k)+S(k)\}]+g_I\cdot p_L,R\cdot s(n-t_\text{cont}, \text{ipsil}) \quad \text{[Equation 13]}$$

Meanwhile, as described above, the additional filter may include a spatial filter for simulating the spatial characteristics of a virtual sound source corresponding to an input audio signal. In this case, the spatial characteristics may include at least one of spread, volumization, blur, or width control effects. A characteristic of a sound source which is sound localized by using HRTF is a point-like. Thereby, the user may be experienced a sound effect such that the input audio signal is heard from the position corresponding to the virtual sound source on the three-dimensional space.

However, in the realistic three-dimensional spatial sound, the geometrical characteristics of the sound may be changed according to size of a sound source corresponding to the sound and distance from the listener to the sound source. For example, a sound of a wave or a thunder may be a sound having an area characteristic rather than a sound heard from a specific point. Meanwhile, a binaural filter for reproducing effects on a sound source other than a point may be difficult to generate through measurements. In addition, in order to reproduce the effect on the sound source other than the point, it may be difficult to construct a system capacity for storing data corresponding to various sound source environments.

Figure 22:
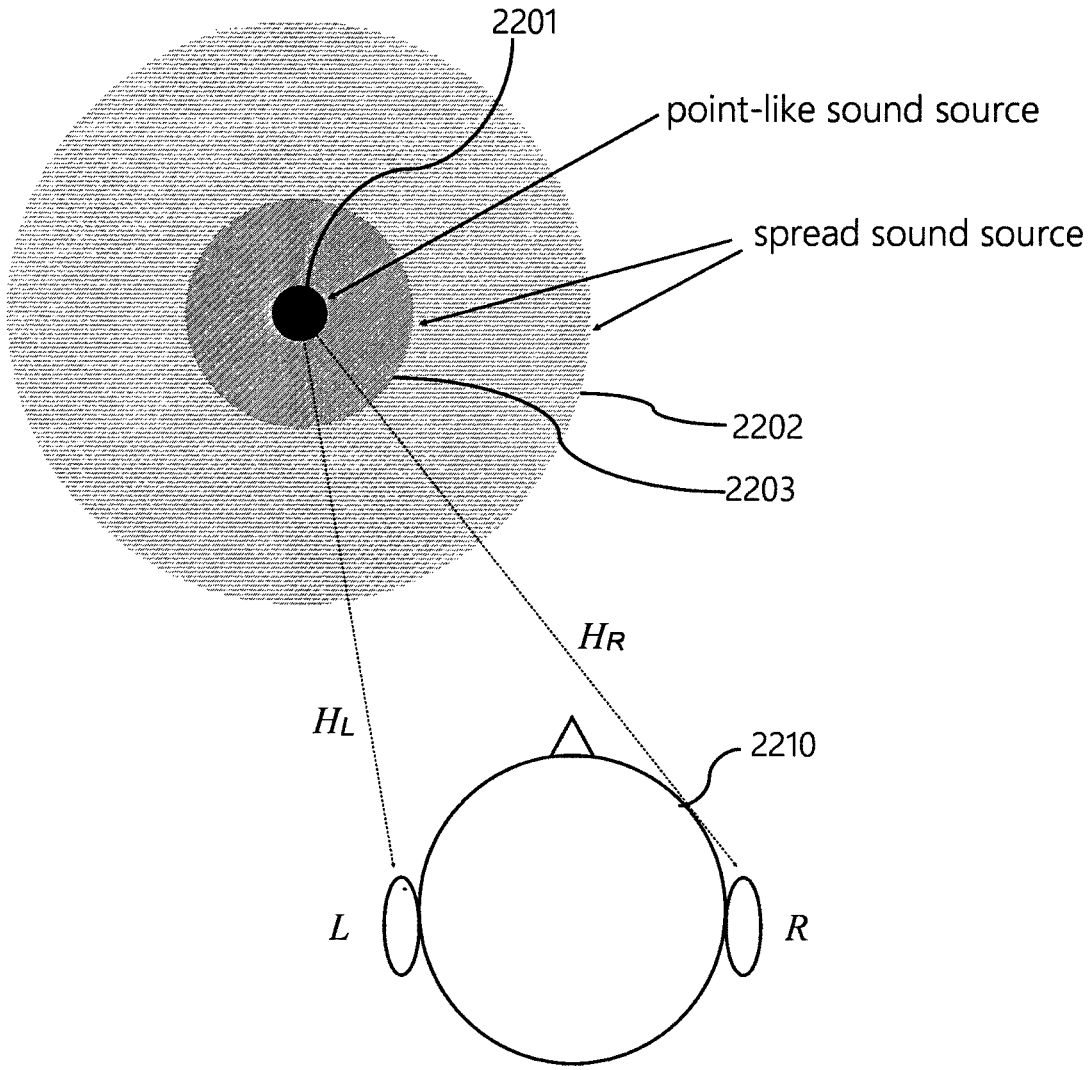
FIG. 22 illustrates an example of a sound effect by a spatial filter.

Accordingly, the audio signal processing device may generate a spatial filter based on the obtained HRTF. In addition, the audio signal processing device may generate an output audio signal based on the obtained HRTF and the spatial filter. Hereinafter, a method by which an audio signal processing device generates an output audio signal by using another additional filter will be described with reference to FIGS. 22 to 28. FIG. 22 shows an example of a sound effect by a spatial filter. In FIG. 22, a listener 2210 may distinguish a virtual sound source 2201 having a point characteristic, and a first spread sound source 2202 and a second spread sound source 2203 having different size of areas, respectively. This is based on an apparent source width (ASW) cognitive effect acoustically.

Figure 23:
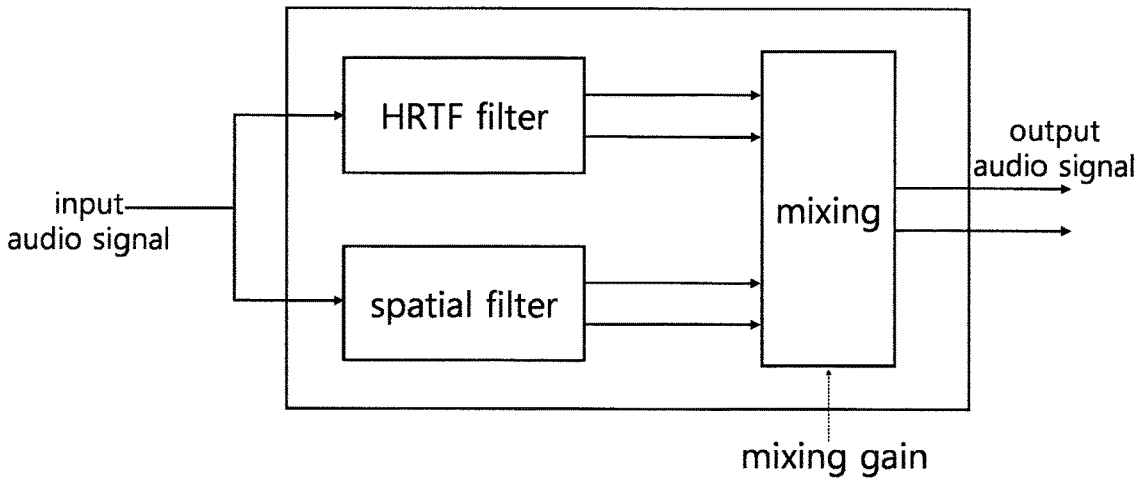
FIG. 23 is a diagram illustrating a method for an audio signal processing device according to an embodiment of the present disclosure to generate an output audio signal based on a plurality of filters.

FIG. 23 is a diagram illustrating a method for an audio signal processing device according to an embodiment of the present disclosure to generate an output audio signal based on a plurality of filters. According to an embodiment, the audio signal processing device may generate a spatial filter based on a size of an object modeled by a virtual sound source corresponding to an input audio signal and a distance from a listener to the virtual sound source. The audio signal processing device may generate a second output audio signal based on the spatial filter. The audio signal processing device may mix the first output audio signal described above and the second output audio signal generated based on the spatial filter to generate a final output audio signal. In FIG. 23, the audio signal processing device may generate left and right output audio signals y_L, y_R as shown in Equation 14.

$$y_L=g_H\cdot h_L*s+g_D\cdot d_L*s$$

$$y_R=g_H\cdot h_R*s+g_D\cdot d_R*s \qquad \text{[Equation 14]}$$

In Equation 14, 's' denotes an input audio signal, and h_L and h_R denote left and right HRTF filters (first filters), respectively. Further, d_L and d_R denote left and right spatial filters (second filters), respectively. g_H and g_D denote the mixing gains applied to the first filter and the second filter, respectively. In addition, denotes a convolution. In this case, the audio signal processing device may filter the input audio signal by a fast convolution method through Fourier transform and inverse Fourier transform. Meanwhile, the method of FIG. 23 requires an additional filtering operation on the same input audio signal in addition to the binaural rendering by using the existing HRTF, so that the amount of computation may be increased.

Figure 24:
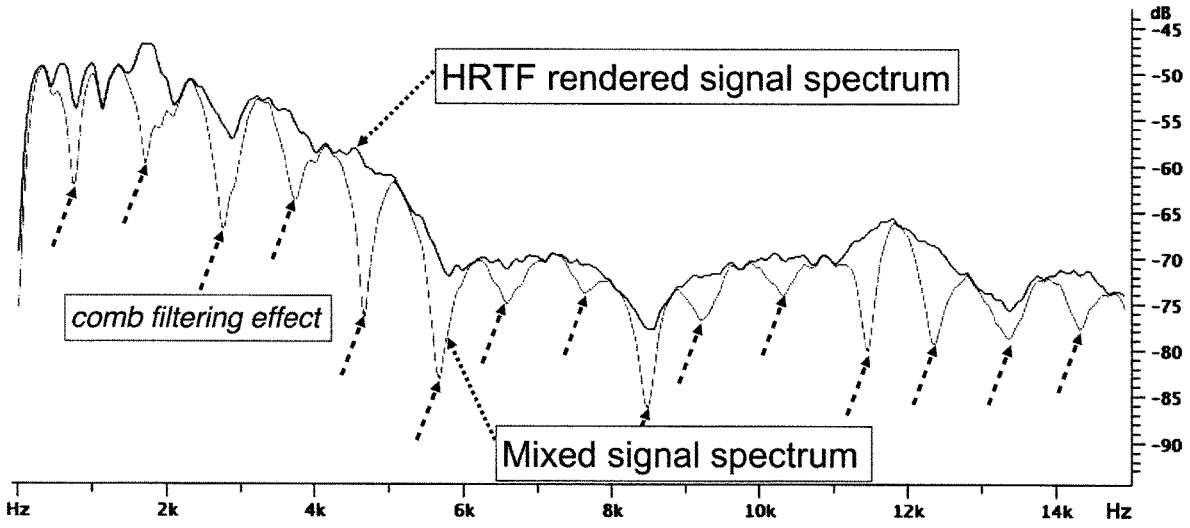
FIG. 24 is a diagram illustrating the deterioration in sound quality due to a comb-filtering effect.

In addition, a deterioration in sound quality may occur due to a difference in phase response between the first filter and the second filter during the mixing process. FIG. 24 is a diagram illustrating the deterioration in sound quality due to a comb-filtering effect. The audio signal processing device may mix the audio signal filtered based on a plurality of filters whose phase responses are not matched. In this case, the frequency response of the mixed signal may differ from that of the rendered audio signal based on the HRTF, resulting in timbre distortion.

Figure 25:
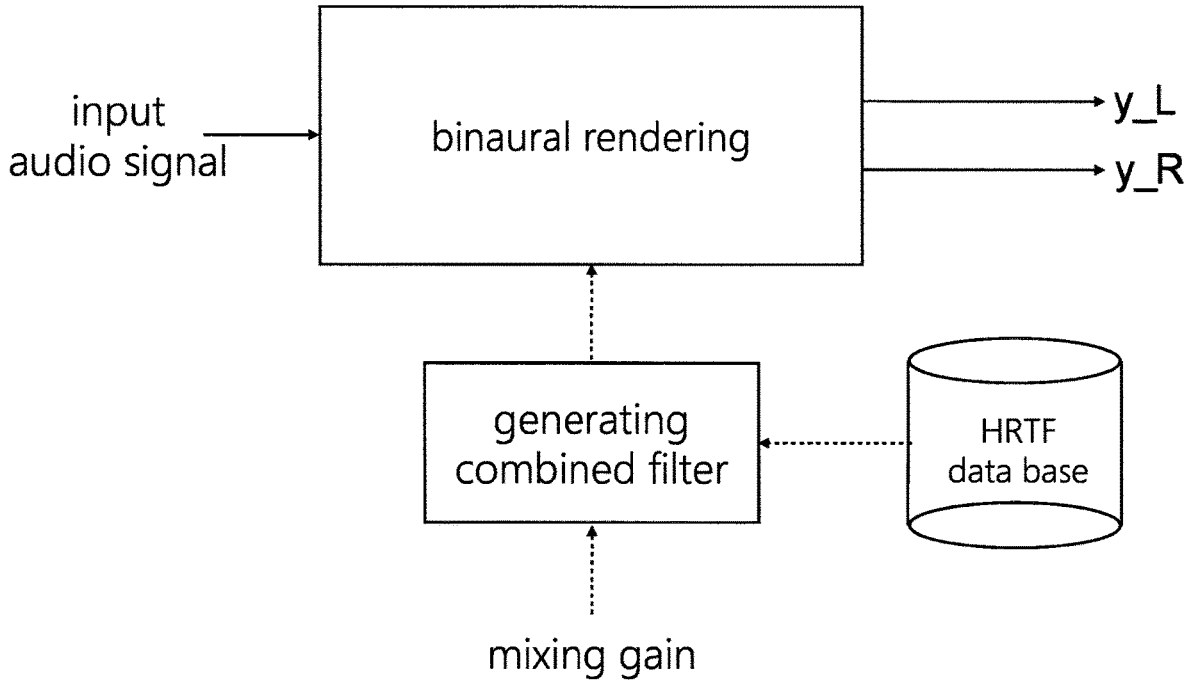
FIG. 25 is a diagram illustrating a method for an audio signal processing device according to an embodiment of the present disclosure to generate a combined filter by combining a plurality of filters.

FIG. 25 is a diagram illustrating a method for an audio signal processing device according to an embodiment of the present disclosure to generate a combined filter by combining a plurality of filters. According to an embodiment, the audio signal processing device may combine the first filter described above and a plurality of additional filters to generate a single combined filter. Thereby, the audio signal processing device may reduce the amount of computation added by a separate binaural rendering using the additional filters. Referring to FIG. 25, an audio signal processing device may obtain a first filter (HRTF) from an HRTF database storing a plurality of HRTFs. Also, the audio signal processing device may generate a second filter based on a size of an object modeled by a virtual sound source corresponding to an input audio signal and a distance from a listener to the virtual sound source. In this case, the audio signal processing device may obtain at least one of the first filter or an HRTF corresponding to the position different from the first filter, from the HRTF database. Further, the audio signal processing device may generate the second filter by using at least one of the first filter or the HRTF corresponding to the position different from the first filter.

Next, the audio signal processing device may generate the combined filter including H_L_new and H_R_new by interpolating the first filter and the second filter. In this case, the audio signal processing device may generate H_L_new and H_R_new by applying the above-described mixing gain to the magnitude response of each of the first filter and the second filter. The audio signal processing device may adjust the strength of the effect of each filter by using the mixing gain.

Further, the audio signal processing device may perform interpolation for each of the left filter and the right filter, of each of the first filter and the second filter. The interpolation may be performed in the time domain, or may be performed in the frequency domain via the Fourier transform. Equation 15 shows a method for an audio signal processing device to generate a left combined filter based on the first left filter and the second left filter in the frequency domain. In Equation 15, mag {X (k)} denotes the magnitude component of the filter X for k-th frequency bin, and pha {X (k)} denotes the phase component of the filter X for k-th frequency bin. Also, g_H and g_D represent the mixing gains applied to the left first filter and the left second filter, respectively.

$$H_L_new(k)=mag\{H_L_new(k)\}\cdot exp[pha\{H_L_new(k)\}], \qquad \text{[Equation 15]}$$

where mag{H_L_new(k)}=g_H·mag{H_L(k)}+g_D·mag{D_L(k)}, and pha{H_L_new(k)}=g_H·pha{H_L(k)}+g_D·pha{D_L(k).

Meanwhile, an audio signal processing device according to an embodiment of the present disclosure may generate a combined filter by interpolating only the magnitude response of each of a plurality of filters. The audio signal processing device may use the phase response of the HRTF which is the first filter, as the phase response of the combined filter. Thus, the audio signal processing device may generate a combined filter based on the mixing gain determined in real-time. The audio signal processing device may omit the operation required to interpolate the phase response, to reduce the total amount of computation required in real-time operation. Equation 16 shows a method for the audio signal processing device to interpolate only the magnitude response of a plurality of filters to generate the combined filter.

$$H_L_new'(k)=mag\{H_L_new(k)\}\cdot exp[pha\{H_L_new\}] \qquad \text{[Equation 16]}$$

where, mag{H_L_new(k)}=g_H·mag{H_L(k)}+g_D·mag{D_L(k)} and, pha{H_L_new(k)}=pha{H_L(k)}

In Equation 16, mag {X (k)} denotes the magnitude component of the filter X for the k-th frequency bin, and pha {X (k)} denotes the phase component of the filter X for the k-th frequency bin. Also, g_H and g_D represent the mixing gains applied to the left first filter and the left second filter, respectively. Equation 17 and Equation 18 show a method for the audio signal processing device to generate the left and right output audio signals Y_L'(k), Y_R' (k)) by using the combined filter generated through Equation 16. In Equation 17 and Equation 18, mag {X (k)} denotes the magnitude component of the filter X for the k-th frequency bin, and pha {X (k)} denotes the phase component of the filter X for the k-th frequency bin. Also, g_H and g_D represent the mixing gain applied to the first filter and the second filter, respectively.

$$Y_L'(k)=g_H\cdot H_L(k)\cdot S(k)+g_D\cdot D_L(k)\cdot S(k)=\{g_H\cdot H_L(k)+g_D\cdot D_L(k)\}\cdot S(k)=$$

$$[g_H \cdot \mathrm{mag}\{H_L(k)\} \cdot \exp[\mathrm{pha}\{H_L(k)\}]+ g_D \cdot \mathrm{mag}\{D_L(k)\} \cdot \exp[\mathrm{pha}\{H_L(k)\}]] \cdot S(k)= [g_H+g_D \cdot \mathrm{mag}\{D_L(k)\} \cdot \mathrm{mag}\{H_L_\mathrm{inv}(k)\}] \cdot H_L(k) \cdot S(k)=g_\mathrm{new}_L(k) \cdot H_L(k) \cdot S(k) \quad \text{[Equation 17]}$$

where, g_new_L(k)=g_H+g_D mag{D_L(k)}·mag{H_L_inv(k)}, and mag{H_L_inv(k)}=1/mag{H_L(k)}

$$Y_R'(k)=g_H \cdot H_R(k) \cdot S(k)+g_D \cdot D_R(k) \cdot S(k)= g_\mathrm{new}_R(k) \cdot H_R(k) \cdot S(k) \quad \text{[Equation 18]}$$

where, g_new_R(k)=g_H+g_D·mag{D_R(k)}·mag{H_R_inv(k)}, and mag{H_R_inv(k)}=1/mag{H_R(k)}

In Equation 17 and 18, the audio signal processing device generate the left and right combined filter based on a mixing gain g_H, g_D, a magnitude response of the second filter mag_D_R (k), and an inverse magnitude response of the first filter mag{H_R_inv(k)}. In this case, the inverse magnitude response of the first filter mag{H_R_inv(k)} may be a value calculated previously in the HRTF database. The audio signal processing device may generate the combined filters g_new_L (k), g_new_R (k) by using the magnitude response of the first filter, not the inverse magnitude response of the first filter, as in intermediate results of Equation 17 and Equation 18.

Figure 26:
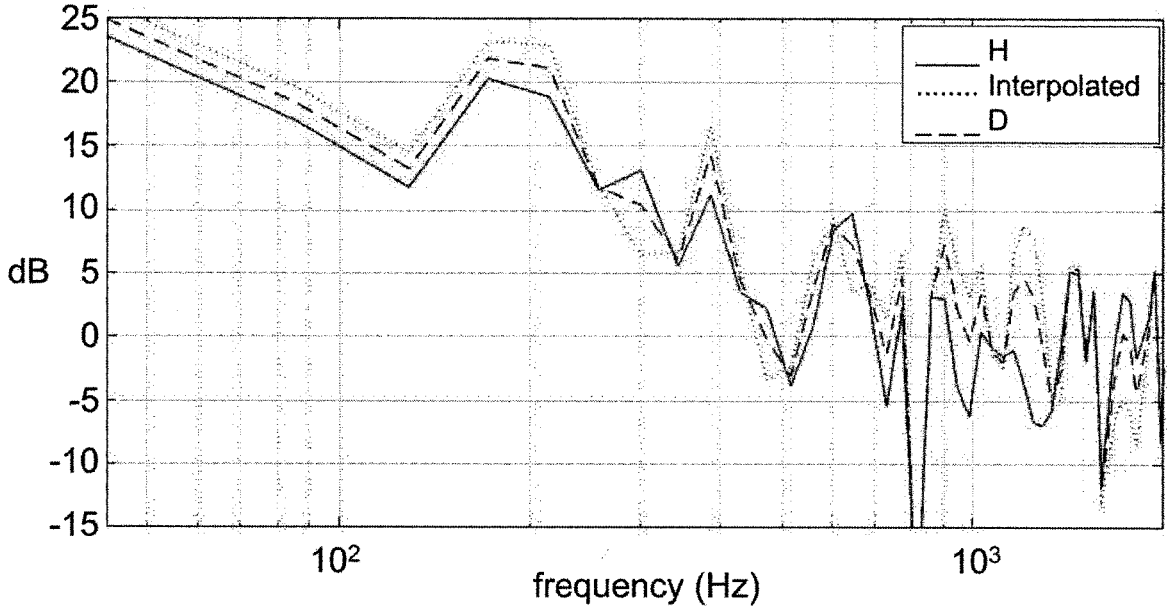
FIG. 26 is a diagram illustrating a combined filter generated by interpolating a plurality of filters in a frequency domain in an audio signal processing device according to an embodiment of the present disclosure.

FIG. 26 is a diagram illustrating a combined filter generated by interpolating a plurality of filters in a frequency domain in an audio signal processing device according to an embodiment of the present disclosure. In FIG. 26, the solid line represents the first filter, and the broken line represents the second filter. The dashed line represents the magnitude component of the frequency response of the combined filter.

Figure 27:
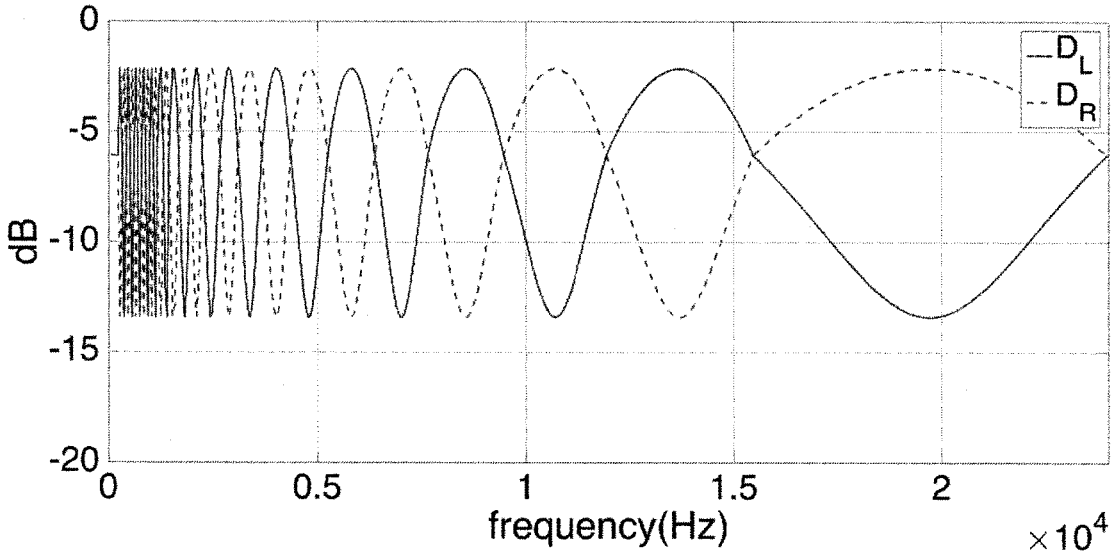
FIG. 27 is an illustration of a frequency response of a spatial filter according to an embodiment of the present disclosure.

FIG. 27 is an illustration of a frequency response of a spatial filter according to an embodiment of the present disclosure. According to an embodiment, an audio signal processing device may adjust an inter-aural cross-correlation (IACC) between a binaural rendered 2-channel audio signals based on the size of a sound source. If the listener listens to a low-channel audio signal with low IACC, the listener can be experienced that the two audio signals are coming from far away from each other. The spatial filter shown in FIG. 27 may be a filter that reduces the IACC between left and right binaural signals. The audio signal processing device may reduce the IACC between the left and right binaural signals by crossing the level difference for each frequency sub-band. Here, the sub-band may be a part of the entire frequency domain of the signal, and each sub-band may be continuous. Each sub-band may comprise at least one frequency bin. When the frequency domain is divided into a plurality of sub-bands, band-sizes of the plurality of sub-bands may be the equal. Alternatively, the band-sizes of respective sub-bands may be different from each other. For example, the audio signal processing device may set the band-sizes of respective sub-bands to different values, according to the auditory scale such as a Bark scale or an Octave band. FIG. 27 shows a case in which the band-size of a sub-band corresponding to a lower frequency is smaller than that of a higher frequency.

Figure 28:
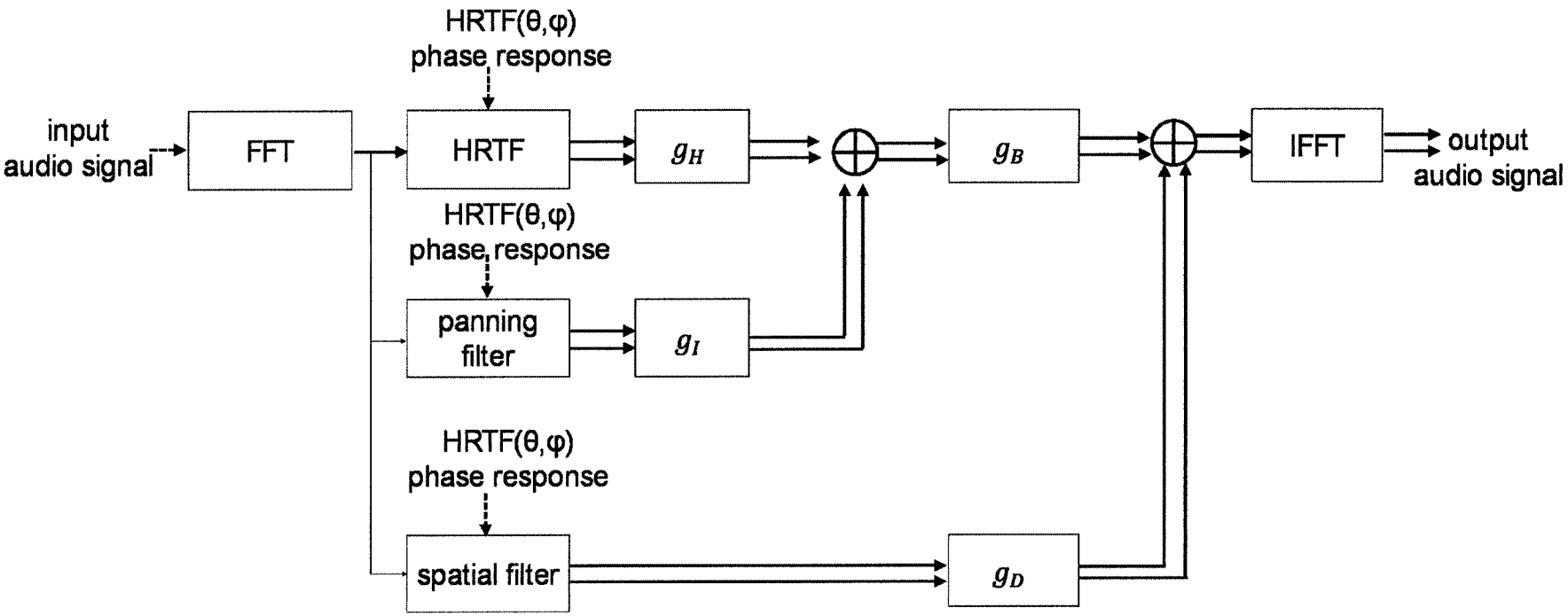
FIG. 28 is a diagram illustrating a method for an audio signal processing device according to an embodiment of the present disclosure to generate a final output audio signal based on the HRTF, panning filter, and spatial filter described above.

FIG. 28 is a diagram illustrating a method for an audio signal processing device according to an embodiment of the present disclosure to generate a final output audio signal based on the HRTF, panning filter, and spatial filter described above. According to an embodiment, the audio signal processing device may obtain a HRTF having a linear phase response. Further, the audio signal processing device may use the phase response of the obtained HRTF as a phase response of each of the panning filter and the spatial filter. Referring to Equation 19, the audio signal processing device may generate an output audio signal Y_BES (k) based on the HRTF and the panning filter. Referring to Equation 20, the audio signal processing device may generate an output audio signal Y_sprd (k) based on the HRTF and the spatial filter.

$$Y_BES(k)=S(k) \cdot H_\mathrm{lin}(k) \cdot g_H+S(k) \cdot \mathrm{IP}(k) \cdot p_L,R \cdot g_I= (k) \cdot \mathrm{mag}\{H_\mathrm{lin}(k)\} \cdot \mathrm{pha}\{H_\mathrm{lin}(k)\} \cdot g_H+S(k) \cdot \mathrm{pha}\{H_\mathrm{lin}(k)\} \cdot p_L,R \cdot g_I=S(k) \cdot H_\mathrm{lin}(k) \cdot [g_H+ g_I \cdot p_L,R \cdot \mathrm{mag}\{1/H_\mathrm{lin}(k)\}) \quad \text{[Equation 19]}$$

$$Y_\mathrm{sprd}(k)=S(k) \cdot H_\mathrm{lin}(k) \cdot g_H+S(k) \cdot D_\mathrm{lin}(k) \cdot g_D=S(k) [H_\mathrm{lin}(k) \cdot g_H+\mathrm{mag}\{D_\mathrm{lin}(k)\} \cdot \mathrm{pha}\{H_\mathrm{lin}(k)\} \cdot g_D]=S(k) \cdot H_\mathrm{lin}(k)[g_H+\mathrm{mag}\{D_\mathrm{lin}(k)\} \cdot \mathrm{mag}\{1/ H_\mathrm{lin}(k)\} \cdot g_D] \quad \text{[Equation 20]}$$

In Equation 19 and Equation 20, mag {X (k)} denotes the magnitude component of the filter X for the k-th frequency bin, and pha {X (k)} denotes the phase component of the filter X for the k-th frequency bin. Also, H_lin denotes the HRTF generated based on the linearized phase response, p_L, R denotes the left or right panning gain, and D_lin denotes the spatial filter generated based on the linearized phase response of the HRTF. Also, g_H, g_I, and g_D represent mixing gains corresponding to the HRTF, the panning filter, and the spatial filter, respectively. IP (k) represents an impulse response having the same phase as H_lin.

Equation 21 represents a final output audio signal Y_BES+Sprd(k). Here, the audio signal processing device may generate the final output audio signal by synthesizing an output audio signal Y_BES to which BES is applied, and an output audio signal Sprd (k) to which characteristics according to the distance and the size of the sound source is applied. In Equation 21, g_B is a mixing gain corresponding to the output audio signal to which the BES is applied.

$$Y_BES+\mathrm{Sprd}(k)=Y_\mathrm{BES}(k) \cdot g_B+S(k) \cdot D_\mathrm{lin}(k) \cdot g_D=S (k) \cdot H_\mathrm{lin}(k) \cdot g_B(g_H+g_I \cdot p \cdot \mathrm{mag}\{1/H_\mathrm{lin}(k)\})+S (k) \cdot \mathrm{mag}\{D_\mathrm{lin}(k)\} \cdot H_\mathrm{lin}(k) \cdot \mathrm{mag}\{1/H_\mathrm{lin}(k)\} \cdot g_D=S(k) \cdot H_\mathrm{lin}(k) \cdot (g_B \cdot g_H+g_B \cdot g_I \cdot p \cdot \mathrm{mag}\{1/ H_\mathrm{lin}(k)\}+g_D \cdot \mathrm{mag}\{D_\mathrm{lin}(k)\} \cdot \mathrm{mag}\{1/H_\mathrm{lin} (k)\})=S(k) \cdot H_\mathrm{lin}(k) \cdot (g_B \cdot g_H+(g_B \cdot g_I \cdot p+ g_D \cdot \mathrm{mag}\{D_\mathrm{lin}(k)\} \cdot \mathrm{mag}\{1/H_\mathrm{lin}(k)\}) \quad \text{[Equation 21]}$$

Referring to FIG. 28, an audio signal processing device may binaural render an input audio signal based on HRTF to generate a first audio signal. The audio signal processing device may binaural render the input audio signal based on the panning filter to generate a second audio signal. The audio signal processing device may binaural render the input audio signal based on the spatial filter to generate a third audio signal. Next, the audio signal processing device may combine the first audio signal and the second audio signal to generate a fourth audio signal to which the BES effect is applied. Further, the audio signal processing device may synthesize the third audio signal and the fourth audio signal, and perform an IFFT on the synthesized audio signal to generate an output audio signal. FIG. 28 and Equation 21, the audio signal processing device synthesizes the first audio signal and the second audio signal first, and then synthesizes the third audio signal to generate an output audio signal. However, the present disclosure is not limited thereto. For example, the audio signal processing device may combine the output audio signals generated based on the respective filters through a single synthesis process. In this case, the above-described mixing gains g_H and g_I may be modified based on g_B and g_D.

Meanwhile, according to an embodiment of the present disclosure, the input audio signal may be simulated through a plurality of virtual sound sources. For example, the input audio signal may include at least one of a plurality of channel signals or an ambisonics signal. In this case, the audio signal processing device may simulate the input audio signal through a plurality of virtual sound sources. For example, the audio signal processing device may binaural render an audio signal assigned to each virtual sound source based on a plurality of HRTFs corresponding to each of a plurality of virtual sound sources, thereby generating an output audio signal. In this case, the audio signals assigned to respective virtual sound sources may be highly correlated. In addition, the phase responses of a plurality of HRTFs corresponding to respective virtual sound sources may be different from each other. As a result, the sound quality degradation due to the above-described comb-filtering effect may occur in the output audio signal. The device for processing an audio signal according to an embodiment of the present disclosure may match the phase response of each of a plurality of HRTFs corresponding to each virtual sound source. Accordingly, the audio signal processing device may mitigate the deterioration in sound quality caused by binaural rendering of the plurality of channel signals or the ambisonics signal correlated highly.

Specifically, the audio signal processing device may generate an output audio signal by using a plurality of different HRTF pairs corresponding to each of the plurality of virtual sound sources. In this embodiment, the virtual sound source may be a channel corresponding to the channel signal or a virtual channel for rendering the ambisonics signal. Further, the audio signal processing device may convert the ambisonics signal into virtual channel signals corresponding to each of a plurality of virtual sound sources arranged with respect to the head direction of the listener. In this case, the plurality of virtual sound sources may be arranged according to a sound source layout. For example, the source layout may be a virtual cube whose entire vertex is located on a unit sphere centered at the listener. In this case, the plurality of virtual sound sources may be located at the vertices of the virtual cube, respectively.

Hereinafter, for convenience of explanation, the positions of the plurality of virtual sound sources are referred to as FLU (front-left-up), FRU (front-right-up), FLD (front-Down, Rear-Left-Up, Rear-Right-Up, Rear-Left-Down, and Rear-Right-Down. In the related description of the present disclosure, the case where the sound source layout is the vertex of the cube is described as an example, but the present disclosure is not limited thereto. For example, the sound source layout may be in a form of an octahedral vertex.

The audio signal processing device may obtain a plurality of different HRTF pairs corresponding to each of the plurality of virtual sound sources. Further, the audio signal processing device may analyze each of the plurality of HRTFs in a magnitude response and a phase response. Next, the audio signal processing device may modify the phase response of each of the plurality of HRTFs in the method described above with reference to FIGS. 3 to 9 to generate a plurality of HRTF's having a modified phase response. For example, the audio signal processing device may generate a plurality of ipsilateral HRTF's by setting the phase responses of each of the plurality of ipsilateral HRTFs to be the same linear phase response.

Further, the audio signal processing device may modify the phase response of each of the plurality of contralateral HRTFs. For example, a first HRTF pair corresponding to a first virtual sound source included in a plurality of virtual sound sources may include a first ipsilateral HRTF and a first major HRTF. In this case, the audio signal processing device may obtain a phase response of a first contralateral HRTF' in which difference of the phase response between the first ipsilateral HRTF and the first contralateral HRTF is maintained, with respect to the phase response of a first ipsilateral HRTF'. Next, the audio signal processing device may generate a two-channel output audio signal by rendering the virtual channel signal corresponding to each of the plurality of virtual sound sources based on the plurality of pairs of HRTF' corresponding to positions of the plurality of virtual sound sources.

According to an embodiment of the present disclosure, an audio signal processing device may generate a left phase response and a right phase response based on the sound source layout. As described above, when the sound source layout is the vertex of the virtual cube, the distance from each of the four left vertices with respect to the listener to the left ear of the listener is the same. In addition, the distance from any one of the left vertices to the left ear of the listener is the same as the distance from any one of the four right vertices to the right ear of the listener. If the distance from the source to the left or right ear of the listener is the same, the group-delay applied to the audio signal may be the same. That is, when the sound source layout is left-right symmetric with respect to the listener, the audio signal processing device may generate the HRTF having common phase response for each of the left side and the right side with respect to the listener.

Hereinafter, for convenience of explanation, the four HRTF pairs corresponding to the vertex located on the left side with respect to the listener are referred to as the left group. Also, four HRTF pairs corresponding to the vertex located on the right side of the listener are referred to as the right group. The left group may include HRTF pairs corresponding to the FLU, FLD, RLU, and RLD positions, respectively. Also, the right group may include HRTF pairs corresponding to FRU, FRD, RRU, and RRD positions, respectively.

The audio signal processing device may determine phase responses of the right group and the left group, based on the phase response of each of the plurality of ipsilateral HRTFs included in each of the right group and the left group. In this case, the ipsilateral of the left group represents the left ear of the listener, and the ipsilateral of the right group represents the right ear of the listener. The audio signal processing device may use any one of mean, median value, or mode value of the phase responses of a plurality of left HRTFs included in the left group, as the left group phase response. Further, the audio signal processing device may use any one of mean, median value, or mode value of the phase responses of a plurality of right HRTFs included in the right group, as the right group phase response. In addition, the audio signal processing device may linearize the determined group phase responses.

In addition, the audio signal processing device may generate the ipsilateral HRTF's by modifying the phase response of each of the ipsilateral HRTFs included in each group based on the group phase response obtained for each group. An embodiment described based on ipsilateral HRTFs may be applied in a same or corresponding manner to the contralateral HRTFs. According to another embodiment, the audio signal processing device may select any of the phase responses of each of the four HRTFs included in the left group as the left group phase response. Further, the audio signal processing device may select any one of the phase responses of the four HRTFs included in the right group as the right group phase response. Accordingly, the audio signal processing device may reduce the distortion of timbre while maintaining the image-localization performance in the binaural rendering of the ambisonics signal and the channel signals.

In the present embodiment, the operation of the audio signal processing device is described using the first order ambisonics (FoA) as an example, but the present disclosure is not limited thereto. For example, the above-described method may be applied to a high order ambisonics (HoA) signal including a plurality of sound sources in the same or corresponding manner. This is because the ambisonics signal may be simulated with a linear sum of the spherical harmonics corresponding to each degree even if the ambisonics signal is a higher order ambisonics signal. Also, in case of a channel signal, the above-described method may be applied in the same or corresponding method.

Figure 29:
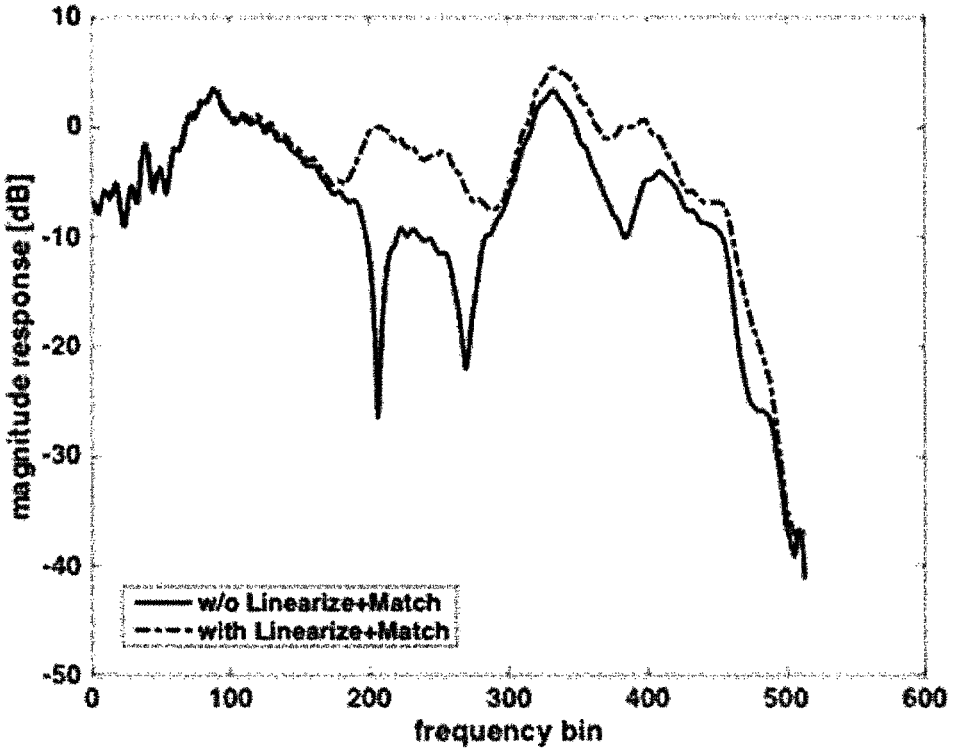
FIG. 29 and FIG. 30 are diagrams illustrating examples of a magnitude component of a frequency response of an output audio signal for each of the cases where the phase responses of each of a plurality of HRTFs corresponding to the plurality of virtual sound sources are not matched to each other or matched.
Figure 30:
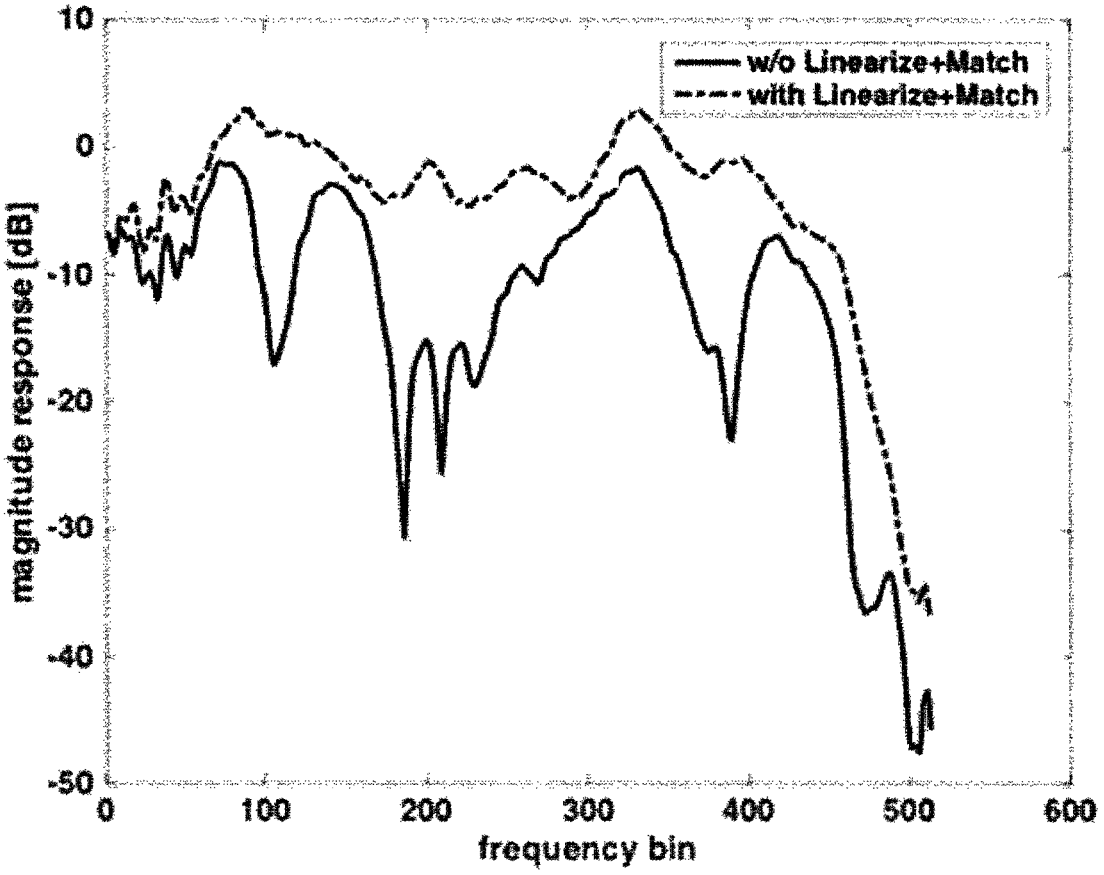

FIGS. 29 and 30 are diagrams illustrating examples of a magnitude component of a frequency response of an output audio signal for each of the cases where the phase responses of each of a plurality of HRTFs corresponding to the plurality of virtual sound sources are not matched to each other or matched. FIG. 29 is an example of frequency response when the sound source layout is a vertex of a virtual cube. In FIG. 29, when the audio signal processing device does not match the phase responses of the plurality of HRTFs corresponding to the plurality of virtual sound sources, the deterioration in sound quality due to the comb-filtering effect occurs (solid line). On the other hand, when the audio signal processing device linearly matches the phase responses of the plurality of HRTFs corresponding to the plurality of virtual sound sources, sound quality degradation due to the comb-filtering effect does not occur (broken line).

FIG. 30 is an example of frequency response when the sound source layout is a vertex of a virtual octahedron. As shown in FIG. 29, when the number of virtual sound sources with respect to the eight virtual sound sources included in the sound source layout increases, sound quality degradation due to comb-filtering may increase. As in FIG. 29, when the audio signal processing device does not match the phase responses of the plurality of HRTFs corresponding to the plurality of virtual sound sources, sound quality degradation occurs due to the comb-filtering effect (solid line). On the other hand, when the audio signal processing device linearly matches the phase responses of the plurality of HRTFs corresponding to the plurality of virtual sound, sound quality degradation due to the comb-filtering effect does not occur sources (broken line).

Some embodiments may also be implemented in the form of a recording medium including instructions executable by a computer, such as program modules, being executed by a computer. A computer readable medium can be any available medium that can be accessed by a computer, and can include both volatile and nonvolatile medium, removable and non-removable medium. The computer-readable medium may also include computer storage medium. The computer storage medium may include both volatile and nonvolatile, removable and non-removable medium implemented in any method or technology for storage of information such as computer readable instructions, data structures, program modules or other data.

Although the present disclosure has been described using the specific embodiments, those skilled in the art could make changes and modifications without departing from the spirit and the scope of the present disclosure. That is, although the embodiments of binaural rendering for audio signals have been described, the present disclosure can be equally applied and extended to various multimedia signals including not only audio signals but also video signals. Therefore, any derivatives that could be easily inferred by those skilled in the art from the detailed description and the embodiments of the present disclosure should be construed as falling within the scope of right of the present disclosure.

What is claimed is:

1. An audio signal processing device comprising:

a processor for outputting an output audio signal generated based on an input audio signal, wherein the processor is configured to:

obtain a first pair of head-related transfer function (HRTF)s comprising a first ipsilateral HRTF and a first contralateral HRTF based on a position of a virtual sound source corresponding to an input audio signal, from a first set of transfer functions comprising HRTFs corresponding to each position with respect to a listener, and generate an output audio signal by performing binaural rendering on the input audio signal based on the first pair of HRTFs, wherein phase responses of a plurality of ipsilateral HRTFs comprised in the first set of transfer functions in a frequency domain are the same regardless of positions corresponding to the plurality of ipsilateral HRTFs, wherein phase responses of at least two of a plurality of contralateral HRTFs comprised in the first set of transfer functions in a frequency domain are not the same, wherein the at least two of the plurality of contralateral HRTFs correspond to different positions with respect to the listener.

2. The audio signal processing device of claim 1, wherein a phase response of the first ipsilateral HRTF is a linear phase response.

3. The audio signal processing device of claim 2, wherein a contralateral group-delay corresponding to a phase response of the first contralateral HRTF is determined based on an ipsilateral group-delay corresponding to the phase response of the first ipsilateral HRTF, and the phase response of the first contralateral HRTF is a linear phase response.

4. The audio signal processing device of claim 3, wherein the contralateral group-delay is a value determined by using an interaural time difference (ITD) information with respect to the ipsilateral group-delay.

5. The audio signal processing device of claim 4, wherein the ITD information is a value obtained based on a measured pair of HRTFs, and the measured pair of HRTFs corresponds to the position of the virtual sound source with respect to the listener.

6. The audio signal processing device of claim 3, wherein the contralateral group-delay is a value determined by using a head modeling information of the listener with respect to the ipsilateral group-delay.

7. The audio signal processing device of claim 3, wherein the ipsilateral group-delay and the contralateral group-delay are integer multiples of a sample according to a sampling frequency in the time domain.

8. The audio signal processing device of claim 7, wherein the processor is configured to:

in the time domain, generate the output audio signal by delaying the input audio signal based on the contralateral group-delay and the ipsilateral group-delay, respectively.

9. The audio signal processing device of claim 3, wherein the processor is configured to:

generate a final output audio signal based on the phase response modified first pair of HRTFs and an additional audio signal in the time domain, and output the final output audio signal, and wherein an ipsilateral group-delay of the additional audio signal is the same as the ipsilateral group-delay of the first ipsilateral HRTF group-delay and a contralateral group-delay of the additional audio signal is the same as the contralateral group-delay of the first contralateral HRTF.

10. The audio signal processing device of claim 9, wherein the processor is configured to:

obtain a panning gain according to the position of the virtual sound source with respect to the listener, filter the input audio signal based on the panning gain, and delay the filtered input audio signal based on the ipsilateral group-delay of the first ipsilateral group-delay and the contralateral group-delay of the first contralateral group-delay to generate the additional audio signal.

11. The audio signal processing device of claim 9, wherein the processor is configured to:

generate the output signal by binaural rendering the input audio signal based on the first pair of HRTFs, generate the additional audio signal by filtering the input audio signal based on an additional filter pair comprising an ipsilateral additional filter and a contralateral additional filter, and generate the final output audio signal by mixing the output audio signal and the additional audio signal in the time domain, and wherein a phase response of the ipsilateral additional filter is the same as the phase response of the first ipsilateral HRTF, and a phase response of the contralateral additional filter is the same as the phase response of the first contralateral HRTF.

12. The audio signal processing device of claim 11, wherein the additional filter pair is a filter generated based on a panning gain according to the position of the virtual sound source with respect to the listener, and a magnitude component of frequency response of each of the ipsilateral additional filter and the contralateral additional filter is constant.

13. The audio signal processing device of claim 11, wherein the additional filter pair is a filter generated based on a size of an object modeled by the virtual sound source and a distance from the listener to the virtual sound source.

14. The audio signal processing device of claim 3, wherein the processor is configured to:

obtain a second pair of HRTFs comprising a second ipsilateral HRTF and a second contralateral HRTF, based on the position of the virtual sound source with respect to the listener, from a second set of transfer functions other than the first set of transfer functions, and generate the output audio signal based on the first pair of HRTFs and the second pair of HRTFs, and wherein a phase response of the second ipsilateral HRTF is same as the phase response of the first ipsilateral HRTF, and a phase response of the second contralateral HRTF is the same as the phase response of the first contralateral HRTF.

15. An operation method for an audio signal processing device outputting an output audio signal generated based on an input audio signal comprising the steps of:

obtaining a pair of head-related transfer function(HRTF)s comprising a ipsilateral HRTF and a contralateral HRTF based on a position of a virtual sound source corresponding to an input audio signal, from a set of transfer functions comprising HRTFs corresponding to each position with respect to a listener; and generating an output audio signal by performing binaural rendering the input audio signal based on the pair of HRTFs, wherein phase responses of a plurality of ipsilateral HRTFs comprised in the set of transfer functions in a frequency domain are the same regardless of positions corresponding to the plurality of ipsilateral HRTFs, wherein phase responses of at least two of a plurality of contralateral HRTFs comprised in the set of transfer functions in a frequency domain are not the same, wherein the at least two of the plurality of contralateral HRTFs correspond to different positions with respect to the listener.

16. The method of claim 15, wherein a phase response of the ipsilateral HRTF is a linear phase response.

17. An audio signal processing device comprising:

a processor for outputting an output audio signal generated based on an input audio signal, the processor is configured to:

obtain a pair of head-related transfer function(HRTF)s comprising an ipsilateral HRTF and a contralateral HRTF based on a position of a virtual sound source corresponding to an input audio signal, from a set of transfer functions comprising HRTFs corresponding to each position with respect to a listener, modify a phase response of the ipsilateral HRTF in a frequency domain to be a specific phase response that is consistent regardless of the position of the virtual sound source, and generate the output audio signal by performing binaural rendering the input audio signal based on the pair of HRTFs, wherein a phase response in a frequency domain of a first contralateral HRTF comprised in the set of transfer functions is not the same with a phase response in a frequency domain of a second contralateral HRTF comprised in the set of transfer functions, wherein the first and second contralateral HRTFs correspond to different positions with respect to the listener.

18. The audio signal processing device of claim 17, wherein the specific phase response is a linear phase response.

* * * * *